US009631442B2

(12) United States Patent
Bansal et al.

(10) Patent No.: US 9,631,442 B2
(45) Date of Patent: Apr. 25, 2017

(54) HEAVE COMPENSATION SYSTEM FOR ASSEMBLING A DRILL STRING

(71) Applicant: Weatherford Technology Holdings, LLC, Houston, TX (US)

(72) Inventors: Ram K. Bansal, Houston, TX (US); Lev Ring, Bellaire, TX (US); Don M. Hannegan, Fort Smith, AR (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 14/541,354

(22) Filed: Nov. 14, 2014

(65) Prior Publication Data

US 2015/0176347 A1 Jun. 25, 2015

(51) Int. Cl.
*E21B 17/01* (2006.01)
*E21B 19/00* (2006.01)
(Continued)

(52) U.S. Cl.
CPC ..... *E21B 19/006* (2013.01); *E21B 17/01* (2013.01); *E21B 17/04* (2013.01); *E21B 17/07* (2013.01);
(Continued)

(58) Field of Classification Search
CPC ..... E21B 17/04; E21B 17/07; E21B 19/06; E21B 19/07; E21B 19/16
(Continued)

(56) References Cited

U.S. PATENT DOCUMENTS 3,311,180 A 3/1967 Gilreath et al.
5,738,173 A * 4/1998 Burge ..... B65H 75/22 166/385
(Continued)

FOREIGN PATENT DOCUMENTS

EP 2378056 A2 10/2011
KP 20110114127 10/2011
WO 2013/0185005 A2 12/2013

OTHER PUBLICATIONS

PCT International Search Report and Written Opinion dated Jul. 20, 2015, for International Application No. PCT/US2014/069379.
(Continued)

*Primary Examiner* — Matthew R Buck
*Assistant Examiner* — Aaron Lembo
(74) *Attorney, Agent, or Firm* — Patterson & Sheridan, LLP

(57) ABSTRACT

A method of deploying a jointed tubular string into a subsea wellbore includes lowering the tubular string into the subsea wellbore from an offshore drilling unit. The tubular string has a slip joint. The method further includes, after lowering, anchoring a lower portion of the tubular string below the slip joint to a non-heaving structure. The method further includes, while the lower portion is anchored: supporting an upper portion of the tubular string above the slip joint from a rig floor of the offshore drilling unit; after supporting, adding one or more joints to the tubular string, thereby extending the tubular string; and releasing the upper portion of the extended tubular string from the rig floor. The method further includes: releasing the lower portion of the extended tubular string from the non-heaving structure; and lowering the extended tubular string into the subsea wellbore.

19 Claims, 24 Drawing Sheets

(51) Int. Cl.

| | |
|---|---|
| ***E21B 17/04*** | (2006.01) |
| ***E21B 19/07*** | (2006.01) |
| ***E21B 21/00*** | (2006.01) |
| ***E21B 33/038*** | (2006.01) |
| ***E21B 23/01*** | (2006.01) |
| ***E21B 31/20*** | (2006.01) |
| ***E21B 33/129*** | (2006.01) |
| ***E21B 47/09*** | (2012.01) |
| ***E21B 17/07*** | (2006.01) |
| ***E21B 19/06*** | (2006.01) |
| ***E21B 19/16*** | (2006.01) |

(52) U.S. Cl.
CPC ..... *E21B 19/06* (2013.01); *E21B 19/07* (2013.01); *E21B 19/16* (2013.01); *E21B 21/001* (2013.01); *E21B 23/01* (2013.01); *E21B 31/20* (2013.01); *E21B 33/038* (2013.01); *E21B 33/1292* (2013.01); *E21B 47/0905* (2013.01)

(58) Field of Classification Search
USPC ..... 166/341, 355
See application file for complete search history.

(56) References Cited

U.S. PATENT DOCUMENTS

| | | | | |
|---|---|---|---|---|
| 6,039,118 | A | 3/2000 | Carter et al. | |
| 6,070,670 | A | 6/2000 | Carter et al. | |
| 6,263,982 | B1 * | 7/2001 | Hannegan | E21B 21/001 175/195 |
| 7,086,481 | B2 | 8/2006 | Hosie et al. | |
| 7,300,033 | B1 | 11/2007 | Whitby et al. | |
| 7,370,707 | B2 * | 5/2008 | McDaniel | E21B 19/004 166/380 |
| 7,438,505 | B2 | 10/2008 | Olsen et al. | |
| 7,784,546 | B2 * | 8/2010 | Patton | E21B 33/06 114/268 |
| 7,874,364 | B2 | 1/2011 | Redlinger et al. | |
| 8,347,982 | B2 | 1/2013 | Hannegan et al. | |
| 8,833,469 | B2 * | 9/2014 | Purkis | E21B 34/066 166/250.01 |
| 2001/0040052 | A1 * | 11/2001 | Bourgoyne | E21B 21/001 175/7 |
| 2004/0069496 | A1 | 4/2004 | Hosie et al. | |
| 2005/0061546 | A1 * | 3/2005 | Hannegan | E21B 21/08 175/7 |
| 2006/0260799 | A1 * | 11/2006 | Broussard | E21B 23/01 166/75.14 |
| 2007/0267221 | A1 | 11/2007 | Giroux et al. | |
| 2008/0210471 | A1 * | 9/2008 | Bailey | E21B 21/08 175/48 |
| 2009/0236144 | A1 * | 9/2009 | Todd | E21B 17/01 175/5 |
| 2009/0255683 | A1 | 10/2009 | Mouton et al. | |
| 2009/0304454 | A1 | 12/2009 | Edwards | |
| 2010/0243277 | A1 | 9/2010 | Ring | |
| 2010/0307774 | A1 * | 12/2010 | Tinnen | E21B 23/06 166/387 |
| 2011/0147010 | A1 * | 6/2011 | Ellis | E21B 19/07 166/380 |
| 2011/0253445 | A1 * | 10/2011 | Hannegan | E21B 19/09 175/5 |
| 2012/0037381 | A1 | 2/2012 | Giroux et al. | |
| 2012/0305315 | A1 * | 12/2012 | Bedouet | E21B 17/025 175/50 |
| 2013/0068532 | A1 | 3/2013 | Bansal et al. | |
| 2013/0112479 | A1 | 5/2013 | O'Blenes | |
| 2013/0118752 | A1 * | 5/2013 | Hannegan | E21B 33/16 166/336 |
| 2013/0192841 | A1 | 8/2013 | Feasey et al. | |
| 2013/0206418 | A1 * | 8/2013 | Pettersen | E21B 19/004 166/336 |
| 2013/0327532 | A1 * | 12/2013 | Ring | E21B 33/05 166/335 |
| 2014/0008083 | A1 * | 1/2014 | Ring | E21B 23/06 166/382 |
| 2014/0048331 | A1 | 2/2014 | Boutalbi et al. | |
| 2014/0202767 | A1 | 7/2014 | Feasey | |
| 2014/0262336 | A1 * | 9/2014 | Nikiforuk | E21B 19/06 166/380 |

OTHER PUBLICATIONS

"Active Heave Compensator," Ocean Drilling Program note, date unknown, 3 pages.

Greenfield, W.D. et al.—Abstract (one page) of "Use of Bumper Subs When Drilling from Floating Vessels," SPE 1549-PA, Journal of Petroleum Technology, vol. 19, No. 12, Dec. 1967, pp. 1587-1594.

Weatherford—"Dailey Lubricated Bumper Sub" brochure, date unknown, 5 pages.

Willson, S.M. et al.—"Geomechanics Considerations for Through- and Near-Salt Well Design," SPE 95621, prepared for presentation at the 2005 SPE Annual Technical Conference and Exhibition held in Dallas, Texas, Oct. 12, 2005, 17 pages.

Australian Patent Examination Report dated Jul. 14, 2016, for Australian Patent Application No. 2014366461.

* cited by examiner

HEAVE COMPENSATION SYSTEM FOR ASSEMBLING A DRILL STRING

BACKGROUND OF THE DISCLOSURE

Field of the Disclosure

The present disclosure relates to methods of preventing wellbore formations from being subjected to heave-induced pressure fluctuations during tubular connections, well control procedures, and other times when the tubular is affixed to floating offshore drilling units.

Description of the Related Art

In wellbore construction and completion operations, a wellbore is formed to access hydrocarbon-bearing formations (e.g., crude oil and/or natural gas) by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung from the surface of the well. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Deep water off-shore drilling operations are typically carried out by a mobile offshore drilling unit (MODU), such as a drill ship or a semi-submersible, having the drilling rig aboard and often make use of a marine riser extending between the wellhead of the well that is being drilled in a subsea formation and the MODU. The marine riser is a tubular string made up of a plurality of tubular sections that are connected in end-to-end relationship. The riser allows return of the drilling mud with drill cuttings from the hole that is being drilled. Also, the marine riser is adapted for being used as a guide for lowering equipment (such as a drill string carrying a drill bit) into the hole.

Once the wellbore has reached the formation, the formation is then usually drilled in an overbalanced condition meaning that the annulus pressure exerted by the returns (drilling fluid and cuttings) is greater than a pore pressure of the formation. Disadvantages of operating in the overbalanced condition include expense of the drilling mud and damage to formations by entry of the mud into the formation. Therefore, managed pressure drilling may be employed to avoid or at least mitigate problems of overbalanced drilling. In managed pressure drilling, a lighter drilling fluid is used to keep the exposed formation in a balanced or slightly overbalanced condition, thereby preventing or at least reducing the drilling fluid from entering and damaging the formation. Since managed pressure drilling is more susceptible to kicks (formation fluid entering the annulus), managed pressure wellbores are drilled using a rotating control device (RCD) (aka rotating diverter, rotating BOP, rotating drilling head, or PCWD). The RCD permits the drill string to be rotated and lowered therethrough while retaining a pressure seal around the drill string.

While making drill string connections on a floating rig, the drill string is set on slips with the drill bit lifted off the bottom. The mud pumps are turned off. During such operations, ocean wave heave of the rig may cause a bottom hole assembly of the drill string to act like a piston moving up and down within the exposed formation, resulting in fluctuations of wellbore pressure that are in harmony with the frequency and magnitude of the rig heave. This can cause surge and swab pressures that will affect the bottom hole pressures and may in turn lead to lost circulation or an influx of formation fluid. Annulus returns may also displaced by this piston effect, thereby obstructing attempts to monitor the exposed formation.

SUMMARY OF THE DISCLOSURE

Disclosed are methods of preventing wellbore formations from being subjected to heave induced pressure fluctuations during tubular connections, well control procedures, and other times when the tubular is affixed to floating offshore drilling units. In one embodiment, a method of deploying a jointed tubular string into a subsea wellbore includes lowering the tubular string into the subsea wellbore from an offshore drilling unit. The tubular string has a slip joint. The method further includes, after lowering, anchoring a lower portion of the tubular string below the slip joint to a non-heaving structure. The method further includes, while the lower portion is anchored: supporting an upper portion of the tubular string above the slip joint from a rig floor of the offshore drilling unit; after supporting, adding one or more joints to the tubular string, thereby extending the tubular string; and releasing the upper portion of the extended tubular string from the rig floor. The method further includes: releasing the lower portion of the extended tubular string from the non-heaving structure; and lowering the extended tubular string into the subsea wellbore.

In another embodiment, a heave compensation system for assembling a jointed tubular string includes: a slip joint; an anchor comprising slips movable between an extended position and a retracted position; and a setting tool connecting the slip joint to the anchor. The setting tool includes: an actuation piston operable to move the slips between the positions; a plurality of toggle valves, each valve in fluid communication with a respective face of the setting piston and operable to alternately provide fluid communication between the respective piston face and either a bore of the setting tool or an exterior of the setting tool; and an electronics package operable to alternate the toggle valves.

In another embodiment, a drill string gripper includes a plurality of rams, each ram radially movable between an engaged position and a disengaged position and having a die fastened to an inner surface thereof for gripping an outer surface of a tubular, the rams collectively defining an annular gripping surface in the engaged position. The drill string gripper further includes: a housing having a bore therethrough and cavity for each ram and flanges formed at respective ends thereof; a piston for each ram, each piston connected to the respective ram and operable to move the respective ram between the positions; a cylinder for each ram, each cylinder connected to the housing and receiving the respective piston; and a bypass passage formed though one or more of the rams, the passage operable to maintain fluid communication between upper and lower portions of the housing bore across the engaged rams.

In another embodiment, a method of deploying a tubular string into a subsea wellbore includes lowering the tubular string into the subsea wellbore from an offshore drilling unit. A blowout preventer (BOP) and drill string gripper are connected to a subsea wellhead of the wellbore and the drill string gripper is connected above the BOP. The method further includes: detecting a well control event while lowering the tubular string; engaging the drill string gripper with the tubular string in response to detecting the well control event; and engaging the BOP with the tubular string after engaging the drill string gripper.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
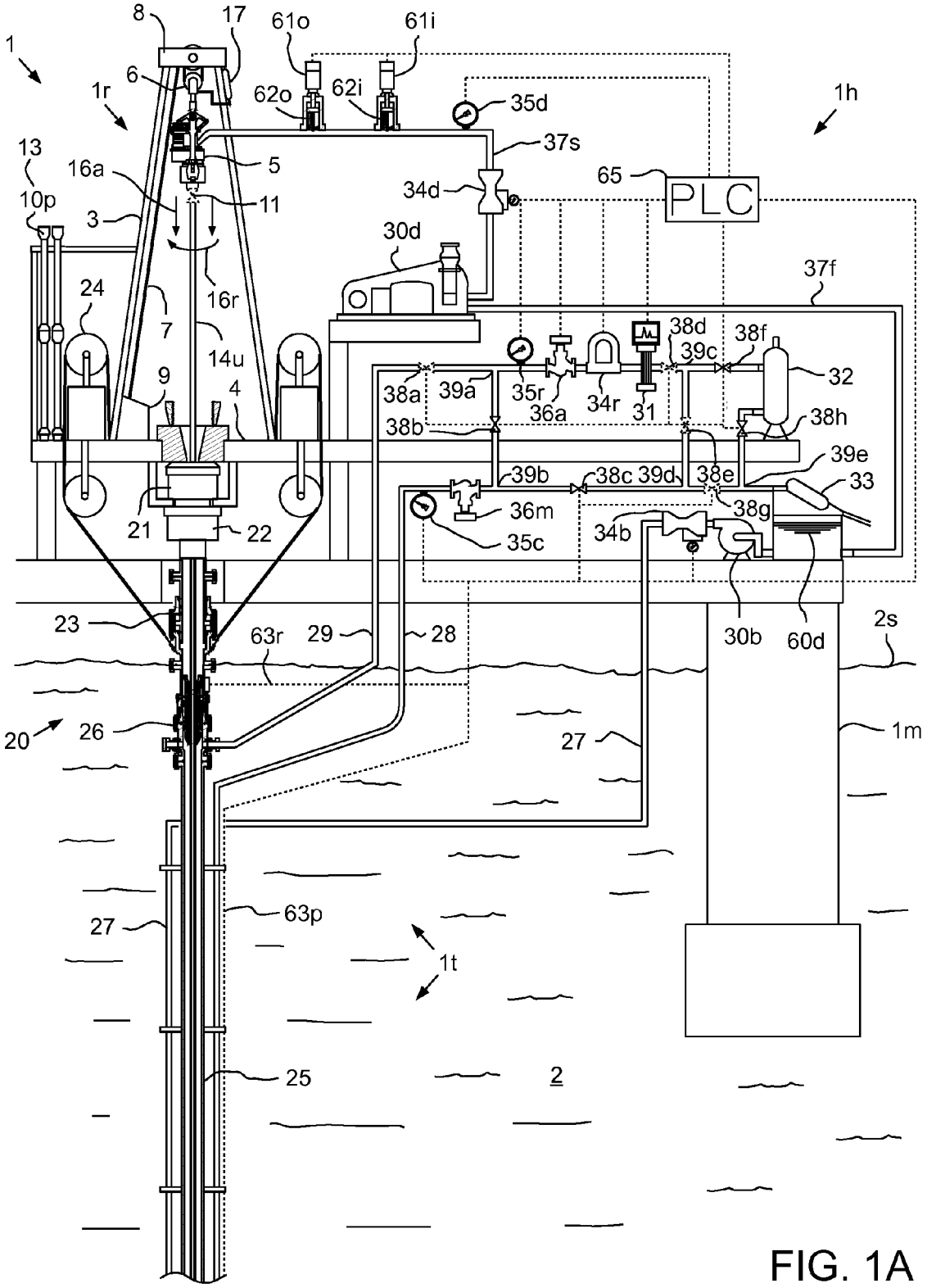
FIGS. 1A-1C illustrate an offshore drilling system having a heave compensation system for assembling a drill string, according to one embodiment of the present disclosure.
Figure 1B:
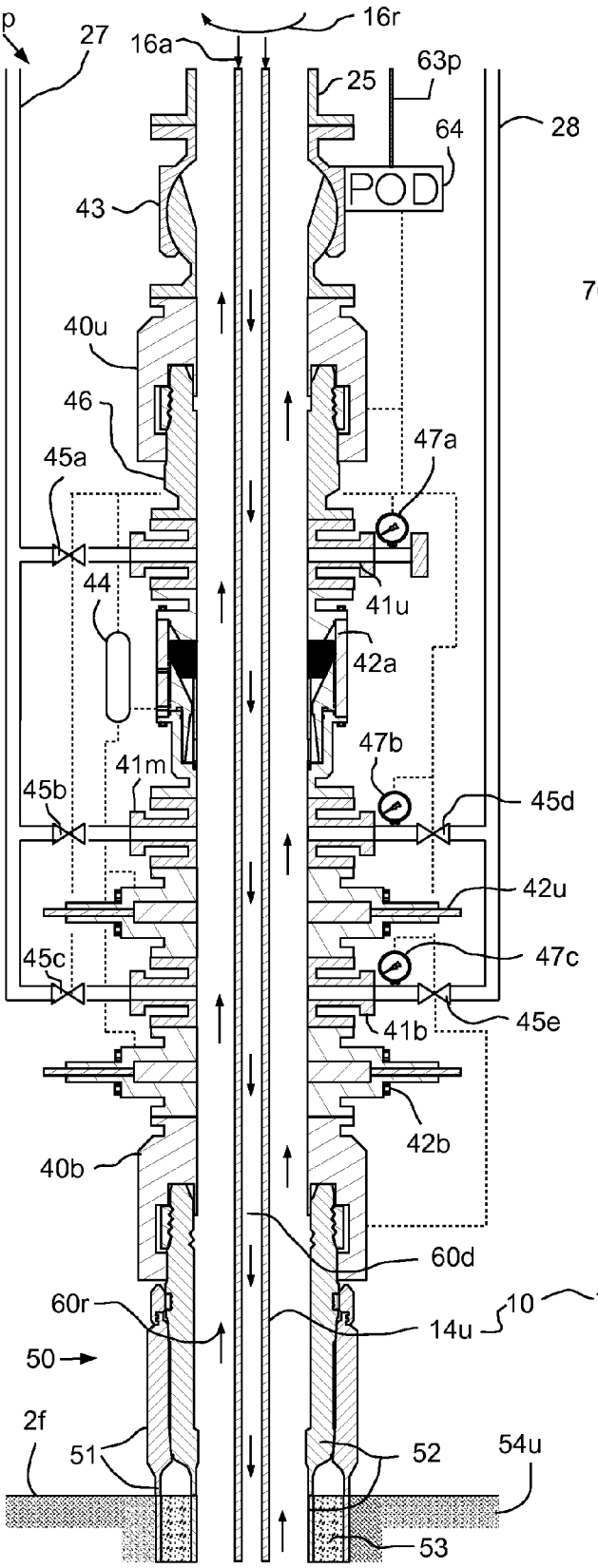
Figure 1C:
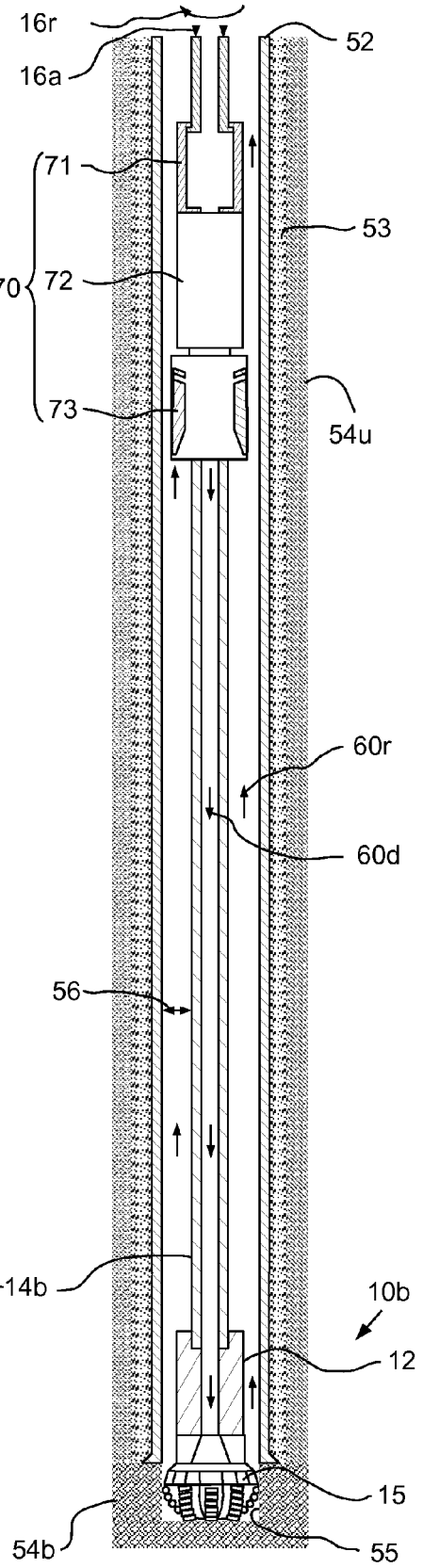

FIGS. 1A-1C illustrate an offshore drilling system 1 having a heave compensation system for assembling a drill string 10, according to one embodiment of the present disclosure. The heave compensation system may be a drill string compensator 70.

The drilling system 1 may further include a MODU 1*m*, such as a semi-submersible, a drilling rig 1*r*, a fluid handling system 1*h*, a fluid transport system 1*t*, and pressure control assembly (PCA) 1*p*, and a drill string 10. The MODU 1*m* may carry the drilling rig 1*r* and the fluid handling system 1*h* aboard and may include a moon pool, through which drilling operations are conducted. The semi-submersible may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 50.

Alternatively, the MODU 1*m* may be a drill ship. Alternatively, a fixed offshore drilling unit or a non-mobile floating offshore drilling unit may be used instead of the MODU 1*m*.

The drilling rig 1*r* may include a derrick 3, a floor 4, a top drive 5, and a hoist. The top drive 5 may include a motor for rotating 16*r* the drill string 10. The top drive motor may be electric or hydraulic. A frame of the top drive 5 may be linked to a rail (not shown) of the derrick 3 for preventing rotation thereof during rotation 16 of the drill string 10 and allowing for vertical movement of the top drive with a traveling block 6 of the hoist. The top drive frame may be suspended from the traveling block 6 by a rig compensator 17. A Kelly valve 11 may be connected to a quill of a top drive 5. The quill may be torsionally driven by the top drive motor and supported from the frame by bearings. The top drive 5 may further have an inlet connected to the frame and in fluid communication with the quill. The traveling block 6 may be supported by wire rope 7 connected at its upper end to a crown block 8. The wire rope 7 may be woven through sheaves of the blocks 6, 8 and extend to drawworks 9 for reeling thereof, thereby raising or lowering the traveling block 6 relative to the derrick 3. An upper end of the drill string 10 may be connected to the Kelly valve 11, such as by threaded couplings.

The rig compensator may 17 may alleviate the effects of heave on the drill string 10 when suspended from the top drive 5. The rig compensator 17 may be active, passive, or a combination system including both an active and passive compensator. Alternatively, the rig compensator 17 may be disposed between the crown block 8 and the derrick 3.

The drill string 10 may have an upper portion 14*u*, a lower portion 14*b*, and the drill string compensator 70 linking the upper and lower portions. The upper portion 14*u* may include joints of drill pipe 10*p* connected together, such as by threaded couplings. The lower portion 14*b* may include a bottomhole assembly (BHA) 10*b* and joints of drill pipe 10*p* connected together, such as by threaded couplings. The BHA 10*b* may be connected to the lower portion drill pipe 10*p*, such as by threaded couplings, and include a drill bit 15 and one or more drill collars 12 connected thereto, such as by threaded couplings. The drill bit 15 may be rotated 16 by the top drive 5 via the drill pipe 10*p* and/or the BHA 10*b* may further include a drilling motor (not shown) for rotating the drill bit. The BHA 10*b* may further include an instrumentation sub (not shown), such as a measurement while drilling (MWD) and/or a logging while drilling (LWD) sub.

The fluid transport system it may include an upper marine riser package (UMRP) 20, a marine riser 25, a booster line 27, a choke line 28, and a return line 29. The UMRP 20 may include a diverter 21, a flex joint 22, a slip joint 23, a tensioner 24, and a rotating control device (RCD) 26. A lower end of the RCD 26 may be connected to an upper end of the riser 25, such as by a flanged connection. The slip joint 23 may include an outer barrel connected to an upper end of the RCD 26, such as by a flanged connection, and an inner barrel connected to the flex joint 22, such as by a flanged connection. The outer barrel may also be connected to the tensioner 24, such as by a tensioner ring (not shown).

The flex joint 22 may also connect to the diverter 21, such as by a flanged connection. The diverter 21 may also be connected to the rig floor 4, such as by a bracket. The slip joint 23 may be operable to extend and retract in response to heave of the MODU 1*m* relative to the riser 25 while the tensioner 24 may reel wire rope in response to the heave, thereby supporting the riser 25 from the MODU 1*m* while accommodating the heave. The riser 25 may extend from the PCA 1*p* to the MODU 1*m* and may connect to the MODU via the UMRP 20. The riser 25 may have one or more buoyancy modules (not shown) disposed therealong to reduce load on the tensioner 24.

The RCD 26 may include a docking station and a bearing assembly. The docking station may be submerged adjacent the waterline 2*s*. The docking station may include a housing, a latch, and an interface. The RCD housing may be tubular and have one or more sections connected together, such as by flanged connections. The RCD housing may have one or more fluid ports formed through a lower housing section and the docking station may include a connection, such as a flanged outlet, fastened to one of the ports.

The docking station latch may include a hydraulic actuator, such as a piston, one or more fasteners, such as dogs, and a body. The latch body may be connected to the housing, such as by threaded couplings. A piston chamber may be formed between the latch body and a mid housing section. The latch body may have openings formed through a wall thereof for receiving the respective dogs. The latch piston may be disposed in the chamber and may carry seals isolating an upper portion of the chamber from a lower portion of the chamber. A cam surface may be formed on an inner surface of the piston for radially displacing the dogs. The latch body may further have a landing shoulder formed in an inner surface thereof for receiving a protective sleeve or the bearing assembly.

Hydraulic passages may be formed through the mid housing section and may provide fluid communication between the interface and respective portions of the hydraulic chamber for selective operation of the piston. An RCD umbilical 63*r* may have hydraulic conduits and may provide fluid communication between the RCD interface and a hydraulic power unit (HPU) via hydraulic manifold. The RCD umbilical 63*r* may further have an electric cable for providing data communication between a control console and the RCD interface via a controller.

The bearing assembly may include a catch sleeve, one or more strippers, and a bearing pack. Each stripper may include a gland or retainer and a seal. Each stripper seal may be directional and oriented to seal against drill pipe 10*p* in response to higher pressure in the riser 25 than the UMRP 20. Each stripper seal may have a conical shape for fluid pressure to act against a respective tapered surface thereof, thereby generating sealing pressure against the drill pipe 10*p*. Each stripper seal may have an inner diameter slightly less than a pipe diameter of the drill pipe 10*p* to form an interference fit therebetween. Each stripper seal may be flexible enough to accommodate and seal against threaded couplings of the drill pipe 10*p* having a larger tool joint diameter. The drill pipe 10*p* may be received through a bore of the bearing assembly so that the stripper seals may engage the drill pipe 10*p*. The stripper seals may provide a desired barrier in the riser 25 either when the drill pipe 10*p* is stationary or rotating.

The catch sleeve may have a landing shoulder formed at an outer surface thereof, a catch profile formed in an outer surface thereof, and may carry one or more seals on an outer surface thereof. Engagement of the latch dogs with the catch sleeve may connect the bearing assembly to the docking station. The gland may have a landing shoulder formed in an inner surface thereof and a catch profile formed in an inner surface thereof for retrieval by a bearing assembly running tool. The bearing pack may support the strippers from the catch sleeve such that the strippers may rotate relative to the docking station. The bearing pack may include one or more radial bearings, one or more thrust bearings, and a self contained lubricant system. The bearing pack may be disposed between the strippers and be housed in and connected to the catch sleeve, such as by threaded couplings and/or fasteners.

Alternatively, the bearing assembly may be non-releasably connected to the housing. Alternatively, the RCD may be located above the waterline and/or along the UMRP at any other location besides a lower end thereof. Alternatively, the RCD may be assembled as part of the riser at any location therealong or as part of the PCA. Alternatively, an active seal RCD may be used instead.

The PCA 1*p* may be connected to a wellhead 50 adjacently located to a floor 2*f* of the sea 2. A conductor string 51 may be driven into the seafloor 2*f*. The conductor string 51 may include a housing and joints of conductor pipe connected together, such as by threaded couplings. Once the conductor string 51 has been set, a subsea wellbore 55 may be drilled into the seafloor 2*f* and a casing string 52 may be deployed into the wellbore. The casing string 52 may include a wellhead housing and joints of casing connected together, such as by threaded couplings. The wellhead housing may land in the conductor housing during deployment of the casing string 52. The casing string 52 may be cemented 53 into the wellbore 55. The casing string 52 may extend to a depth adjacent a bottom of an upper formation 54*u*. The upper formation 54*u* may be non-productive and a lower formation 54*b* may be a hydrocarbon-bearing reservoir.

Alternatively, the lower formation 54*b* may be non-productive (e.g., a depleted zone), environmentally sensitive, such as an aquifer, or unstable. Although shown as vertical, the wellbore 55 may include a vertical portion and a deviated, such as horizontal, portion.

The PCA 1*p* may include a wellhead adapter 40*b*, one or more flow crosses 41*u,m,b*, one or more blow out preventers (BOPs) 42*a,u,b*, a lower marine riser package (LMRP), one or more accumulators 44, and a receiver 46. The LMRP may include a control pod 64, a flex joint 43, and a connector 40*u*. The wellhead adapter 40*b*, flow crosses 41 *u,m,b*, BOPs 42*a,u,b*, receiver 46, connector 40*u*, and flex joint 43, may each include a housing having a longitudinal bore therethrough and may each be connected, such as by flanges, such that a continuous bore is maintained therethrough. The bore may have drift diameter, corresponding to a drift diameter of the wellhead 50. The flex joints 23, 43 may accommodate respective horizontal and/or rotational (aka pitch and roll) movement of the MODU 1*m* relative to the riser 25 and the riser relative to the PCA 1*p*.

Each of the connector 40*u* and wellhead adapter 40*b* may include one or more fasteners, such as dogs, for fastening the LMRP to the BOPs 42*a,u,b* and the PCA 1*p* to an external profile of the wellhead housing, respectively. Each of the connector 40*u* and wellhead adapter 40*b* may further include a seal sleeve for engaging an internal profile of the respective receiver 46 and wellhead housing. Each of the connector 40*u* and wellhead adapter 40*b* may be in electric or hydraulic communication with the control pod 64 and/or further include an electric or hydraulic actuator and an interface, such as a hot stab, so that a remotely operated subsea vehicle (ROV) (not shown) may operate the actuator for engaging the dogs with the external profile.

The LMRP may receive a lower end of the riser 25 and connect the riser to the PCA 1*p*. The control pod 64 may be in electric, hydraulic, and/or optical communication with a programmable logic controller (PLC) 65 and/or a rig controller (not shown) onboard the MODU 1*m* via a pod umbilical 63*p*. The control pod 64 may include one or more control valves (not shown) in communication with the BOPs 42*a,u,b* for operation thereof. Each control valve may include an electric or hydraulic actuator in communication with the umbilical 63*p*. The umbilical 63*p* may include one or more hydraulic and/or electric control conduit/cables for the actuators. The accumulators 44 may store pressurized hydraulic fluid for operating the BOPs 42*a,u,b*. Additionally, the accumulators 44 may be used for operating one or more of the other components of the PCA 1*p*. The PLC 65 and/or rig controller may operate the PCA 1*p* via the umbilical 63*p* and the control pod 64.

A lower end of the booster line 27 may be connected to a branch of the flow cross 41*u* by a shutoff valve 45*a*. A booster manifold may also connect to the booster line 27 and have a prong connected to a respective branch of each flow cross 41*m,b*. Shutoff valves 45*b,c* may be disposed in respective prongs of the booster manifold. Alternatively, a separate kill line (not shown) may be connected to the branches of the flow crosses 41*m,b* instead of the booster manifold. An upper end of the booster line 27 may be connected to an outlet of a booster pump 30*b*. A lower end of the choke line 28 may have prongs connected to respective second branches of the flow crosses 41*m,b*. Shutoff valves 45*d,e* may be disposed in respective prongs of the choke line lower end.

A pressure sensor 47*a* may be connected to a second branch of the upper flow cross 41*u*. Pressure sensors 47*b,c* may be connected to the choke line prongs between respective shutoff valves 45*d,e* and respective flow cross second branches. Each pressure sensor 47*a-c* may be in data communication with the control pod 64. The lines 27, 28 and umbilical 63*p* may extend between the MODU 1*m* and the PCA 1*p* by being fastened to brackets disposed along the riser 25. Each shutoff valve 45*a-e* may be automated and have a hydraulic actuator (not shown) operable by the control pod 64.

Alternatively, the pod umbilical 63*p* may be extended between the MODU and the PCA independently of the riser. Alternatively, the valve actuators may be electrical or pneumatic.

The fluid handling system 1*h* may include one or pumps 30*b,d*, a gas detector 31, a reservoir for drilling fluid 60*d*, such as a tank, a fluid separator, such as a mud-gas separator (MGS) 32, a solids separator, such as a shale shaker 33, one or more flow meters 34*b,d,r*, one or more pressure sensors 35*c,d,r*, and one or more variable choke valves, such as a managed pressure (MP) choke 36*a* and a well control (WC) choke 36*m*, and one or more tag launchers 61*i,o*. The mud-gas separator 32 may be vertical, horizontal, or centrifugal and may be operable to separate gas from returns 60*r*. The separated gas may be stored or flared.

A lower end of the return line 29 may be connected to an outlet of the RCD 26 and an upper end of the return line may be connected to an inlet stem of a first flow tee 39*a* and have a first shutoff valve 38*a* assembled as part thereof. An upper end of the choke line 28 may be connected an inlet stem of a second flow tee 39*b* and have the WC choke 36*m* and pressure sensor 35*c* assembled as part thereof. A first spool may connect an outlet stem of the first tee 39*a* and an inlet stem of a third tee 39*c*. The pressure sensor 35*r*, MP choke 36*a*, flow meter 34*r*, gas detector 31, and a fourth shutoff valve 38*d* may be assembled as part of the first spool. A second spool may connect an outlet stem of the third tee 39*c* and an inlet of the MGS 32 and have a sixth shutoff valve 38*f* assembled as part thereof.

A third spool may connect an outlet stem of the second tee 39*b* and an inlet stem of a fourth tee 39*d* and have a third shutoff valve 38*c* assembled as part thereof. A first splice may connect branches of the first 39*a* and second 39*b* tees and have a second shutoff valve 38*b* assembled as part thereof. A second splice may connect branches of the third 39*c* and fourth 39*d* tees and have a fifth shutoff valve 38*e* assembled as part thereof. A fourth spool may connect an outlet stem of the fourth tee 39*d* and an inlet stem of the fifth tee 39*e* and have a seventh shutoff valve 38*g* assembled as part thereof. A third splice may connect a liquid outlet of the MGS 32 and a branch of the fifth tee 39*e* and have an eighth shutoff valve 38*h* assembled as part thereof. An outlet stem of the fifth tee 39*e* may be connected to an inlet of the shale shaker 33.

A feed line 37*f* may connect an inlet of the mud pump 30*d* to an outlet of the mud tank. A supply line 37*s* may connect an outlet of the mud pump 30*d* to the top drive inlet and may have the flow meter 34*d*, the pressure sensor 35*d*, and the tag launchers 61*i,o* assembled as part thereof. An upper end of the booster line 27 may have the flow meter 34*b* assembled as part thereof. Each pressure sensor 35*c,d,r* may be in data communication with the PLC 65. The pressure sensor 35*r* may be operable to monitor backpressure exerted by the MP choke 36*a*. The pressure sensor 35*c* may be operable to monitor backpressure exerted by the WC choke 36*m*. The pressure sensor 35*d* may be operable to monitor standpipe pressure. Each choke 36*a,m* may be fortified to operate in an environment where drilling returns 60*r* may include solids, such as cuttings. The MP choke 36*a* may include a hydraulic actuator operated by the PLC 65 via the HPU to maintain backpressure in the riser 25. The WC choke 36*m* may be manually operated.

Alternatively, the choke actuator may be electrical or pneumatic. Alternatively, the WC choke 36*m* may also include an actuator operated by the PLC 65.

The flow meter 34*r* may be a mass flow meter, such as a Coriolis flow meter, and may be in data communication with the PLC 65. The flow meter 34*r* may be connected in the first spool downstream of the MP choke 36*a* and may be operable to monitor a flow rate of the drilling returns 60*r*. Each of the flow meters 34*b,d* may be a volumetric flow meter, such as a Venturi flow meter, and may be in data communication with the PLC 65. The flow meter 34*d* may be operable to monitor a flow rate of the mud pump 30*d*. The flow meter 34*b* may be operable to monitor a flow rate of the drilling fluid 60*d* pumped into the riser 25 (FIG. 12E). The PLC 65 may receive a density measurement of drilling fluid 60*d* from a mud blender (not shown) to determine a mass flow rate of the drilling fluid 60*d* from the volumetric measurement of the flow meters 34*b,d*.

Alternatively, a stroke counter (not shown) may be used to monitor a flow rate of the mud pump and/or booster pump instead of the volumetric flow meters. Alternatively, either or both of the volumetric flow meters may be mass flow meters.

The gas detector 31 may be operable to extract a gas sample from the returns 60*r* (if contaminated by formation fluid 62 (FIG. 3C)) and analyze the captured sample to detect hydrocarbons, such as saturated and/or unsaturated C1 to C10 and/or aromatic hydrocarbons, such as benzene, toluene, ethyl benzene and/or xylene, and/or non-hydrocarbon gases, such as carbon dioxide and nitrogen. The gas detector 31 may include a body, a probe, a chromatograph, and a carrier/purge system. The body may include a fitting and a penetrator. The fitting may have end connectors, such as flanges, for connection within the first spool and a lateral connector, such as a flange for receiving the penetrator. The penetrator may have a blind flange portion for connection to the lateral connector, an insertion tube extending from an external face of the blind flange portion for receiving the probe, and a dip tube extending from an internal face thereof for receiving one or more sensors, such as a pressure and/or temperature sensor.

The probe may include a cage, a mandrel, and one or more sheets. Each sheet may include a semi-permeable membrane sheathed by inner and outer protective layers of mesh. The mandrel may have a stem portion for receiving the sheets and a fitting portion for connection to the insertion tube. Each sheet may be disposed on opposing faces of the mandrel and clamped thereon by first and second members of the cage. Fasteners may then be inserted into respective receiving holes formed through the cage, mandrel, and sheets to secure the probe components together. The mandrel may have inlet and outlet ports formed in the fitting portion and in communication with respective channels formed between the mandrel and the sheets. The carrier/purge system may be connected to the mandrel ports and a carrier gas, such as helium, argon, or nitrogen, may be injected into the mandrel inlet port to displace sample gas trapped in the channels by the membranes to the mandrel outlet port. The carrier/purge system may then transport the sample gas to the chromatograph for analysis. The carrier purge system may also be routinely run to purge the probe of condensate. The chromatograph may be in data communication with the PLC to report the analysis of the sample. The chromatograph may be configured to only analyze the sample for specific hydrocarbons to minimize sample analysis time. For example, the chromatograph may be configured to analyze only for C1-C5 hydrocarbons in twenty-five seconds.

Each tag launcher 61*i,o* may include a housing, a plunger, an actuator, and a magazine (not shown) having a plurality of respective wireless identification tags, such as radio frequency identification (RFID) tags, loaded therein. A chambered RFID tag 62*i,o* may be disposed in the respective plunger for selective release and pumping downhole to communicate with the drill string compensator 70. Each plunger may be movable relative to the respective launcher housing between a captured position and a release position. Each plunger may be moved between the positions by the respective actuator. The actuator may be hydraulic, such as a piston and cylinder assembly.

Each RFID tag 62*i,o* may be a passive tag and include an electronics package and one or more antennas housed in an encapsulation. The electronics package may include a memory unit, a transmitter, and a radio frequency (RF) power generator for operating the transmitter. A first RFID tag 62*o* may be programmed with a command for the drill string compensator 70 to shift to an operating mode and a second RFID tag 62*i* may be programmed with a command for the drill string compensator 70 to shift to an idle mode. Each RFID tag 62*i,o* may be operable to transmit a wireless command signal 66*c* (FIG. 5C), such as a digital electromagnetic command signal, to the drill string compensator 70 in response to receiving an activation signal 66*a* therefrom.

Alternatively, RFID tags with a generic shifting signal may be used to shift the compensator between both positions. Alternatively, each actuator may be electric or pneumatic. Alternatively, each actuator may be manual, such as a handwheel. Alternatively, each tag 62*i,o* may be manually launched by breaking a connection in the drill string 10. Alternatively, one or more of the RFID tags 62*i,o* may instead be a wireless identification and sensing platform (WISP) RFID tag. The WISP tag may further a microcontroller (MCU) and a receiver for receiving, processing, and storing data from the drill string compensator 70. Alternatively, one or more of the RFID tags 62*i,o* may be an active tag having an onboard battery powering a transmitter instead of having the RF power generator or the WISP tag may have an onboard battery for assisting in data handling functions. The active tag may further include a safety, such as pressure switch, such that the tag does not begin to transmit until the tag is in the wellbore.

In the shown managed pressure drilling mode, the mud pump 30*d* may pump drilling fluid 60*d* from the drilling fluid tank, through the supply line 37*s* to the top drive 5. The drilling fluid 60*d* may include a base liquid. The base liquid may be base refined or synthetic oil, water, brine, or a water/oil emulsion. The drilling fluid 60*d* may further include solids dissolved or suspended in the base liquid, such as organophilic clay, lignite, and/or asphalt, thereby forming a mud.

The drilling fluid 60*d* may flow from the supply line 37*s* and into the drill string 10 via the top drive 5. The drilling fluid 60*d* may flow down through the drill string 10 and exit the drill bit 15, where the fluid may circulate the cuttings away from the bit and return the cuttings up an annulus 56 formed between an inner surface of the casing 53 or wellbore 55 and an outer surface of the drill string 10. The returns 60*r* (drilling fluid 60*d* plus cuttings) may flow through the annulus 56 to the wellhead 50. The returns 60*r* may continue from the wellhead 50 and into the riser 25 via the PCA 1*p*. The returns 60*r* may flow up the riser 25 to the RCD 26. The returns 60*r* may be diverted by the RCD 26 into the return line 29 via the RCD outlet. The returns 60*r* may continue from the return line 29, through the open (depicted by phantom) first shutoff valve 38*a* and first tee 39*a*, and into the first spool. The returns 60*r* may flow through the MP choke 36*a*, the flow meter 34*r*, the gas detector 31, and the open fourth shutoff valve 38*d* to the third tee 39*c*. The returns 60*r* may continue through the second splice and to the fourth tee 39*d* via the open fifth shutoff valve 38*e*. The returns 60*r* may continue through the third spool to the fifth tee 39*e* via the open seventh shutoff valve 38*g*. The returns 60*r* may then flow into the shale shaker 33 and be processed thereby to remove the cuttings. The shale shaker 33 may discharged the processed fluid into the mud tank, thereby completing a cycle. As the drilling fluid 60*d* and returns 60*r* circulate, the drill string 10 may be rotated 16*r* by the top drive 5 and lowered 16*a* by the traveling block 6, thereby extending the wellbore 55 into the lower formation 54*b*.

Alternatively, the sixth 38*f* and eighth 38*h* shutoff valves may be open and the fifth 38*e* and seventh 38*g* shutoff valves may be closed in the drilling mode, thereby routing the returns 60*r* through the MGS 32 before discharge into the shaker 33.

The PLC 65 may be programmed to operate the MP choke 36*a* so that a target bottomhole pressure (BHP) is maintained in the annulus 56 during the drilling operation. The target BHP may be selected to be within a drilling window defined as greater than or equal to a minimum threshold pressure, such as pore pressure, of the lower formation 54*b* and less than or equal to a maximum threshold pressure, such as fracture pressure, of the lower formation, such as an average of the pore and fracture BHPs.

Alternatively, the minimum threshold may be stability pressure and/or the maximum threshold may be leakoff pressure. Alternatively, threshold pressure gradients may be used instead of pressures and the gradients may be at other depths along the lower formation 54*b* besides bottomhole, such as the depth of the maximum pore gradient and the depth of the minimum fracture gradient. Alternatively, the PLC 65 may be free to vary the BHP within the window during the drilling operation.

A static density of the drilling fluid 60*d* (typically assumed equal to returns 60*r*; effect of cuttings typically assumed to be negligible) may correspond to a threshold pressure gradient of the lower formation 54*b*, such as being equal to a pore pressure gradient. During the drilling operation, the PLC 65 may execute a real time simulation of the drilling operation in order to predict the actual BHP from measured data, such as standpipe pressure from sensor 35*d*, mud pump flow rate from flow meter 34*d*, wellhead pressure from any of the sensors 47*a-c*, and return fluid flow rate from flow meter 34*r*. The PLC 65 may then compare the predicted BHP to the target BHP and adjust the MP choke 36*a* accordingly.

Alternatively, a static density of the drilling fluid 60*d* may be slightly less than the pore pressure gradient such that an equivalent circulation density (ECD) (static density plus dynamic friction drag) during drilling is equal to the pore pressure gradient. Alternatively, a static density of the drilling fluid 60*d* may be slightly greater than the pore pressure gradient.

During the drilling operation, the PLC 65 may also perform a mass balance to monitor for a kick (FIG. 12F) or lost circulation (not shown). As the drilling fluid 60*d* is being pumped into the wellbore 55 by the mud pump 30*d* and the returns 60*r* are being received from the return line 29, the PLC 65 may compare the mass flow rates (i.e., drilling fluid flow rate minus returns flow rate) using the respective counters/meters 34*d,r*. The PLC 65 may use the mass balance to monitor for formation fluid 62 entering the annulus 56 and contaminating 61*r* the returns 60*r* or returns 60*r* entering the formation 54*b*. Upon detection of either event, the PLC 65 may shift the drilling system 1 into a managed pressure riser degassing mode. The gas detector 31 may also capture and analyze samples of the returns 60*r* as an additional safeguard for kick detection.

Alternatively, the PLC 65 may estimate a mass rate of cuttings (and add the cuttings mass rate to the intake sum) using a rate of penetration (ROP) of the drill bit or a mass flow meter may be added to the cuttings chute of the shaker and the PLC may directly measure the cuttings mass rate. Alternatively, the gas detector 31 may be bypassed during the drilling operation. Alternatively, the booster pump 30*b* may be operated during drilling to compensate for any size discrepancy between the riser annulus and the casing/wellbore annulus and the PLC may account for boosting in the BHP control and mass balance using the flow meter 34*b*.

Figures 2A, 2B, 2C:
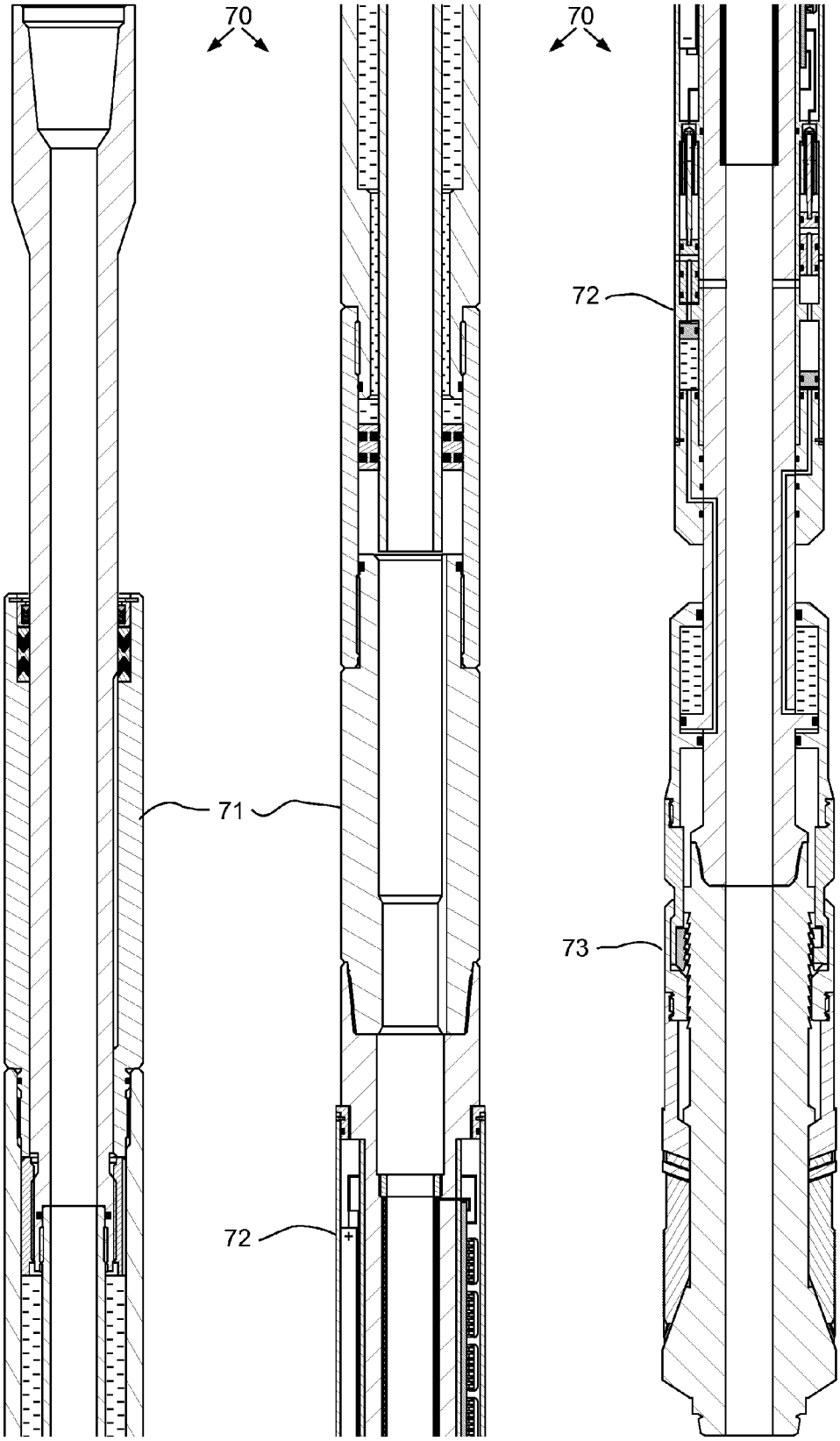
FIGS. 2A-2C illustrate a drill string compensator of the heave compensation system in an idle mode.

FIGS. 2A-2C illustrate the drill string compensator 70 in an idle mode. The drill string compensator 70 may include a slip joint 71, a setting tool 72, and an anchor 73. The setting tool 72 may be connected to a lower end of the slip joint 71, such as by threaded couplings and the anchor 73 may be connected to a lower end of the setting tool 72, such as by threaded couplings. A continuous bore may be formed through the drill string compensator 70 for the passage of drilling fluid 60*d*.

Figures 3A, 3B, 3C, 3D:
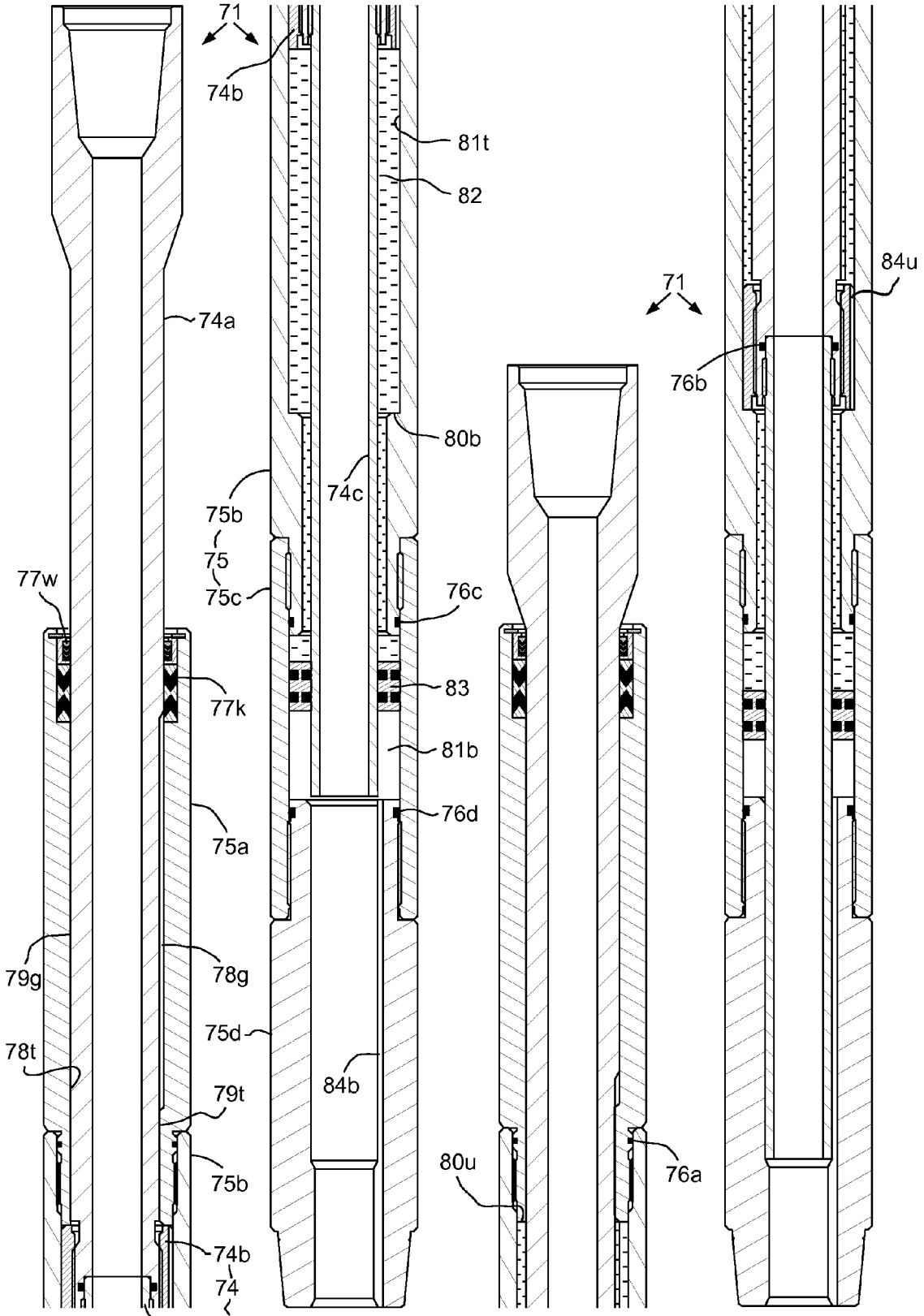
FIGS. 3A and 3B illustrate a slip joint of the compensator in an extended position.
FIGS. 3C and 3D illustrate the slip joint in a retracted position.

FIGS. 3A and 3B illustrate the slip joint 71 in an extended position. FIGS. 3C and 3D illustrate the slip joint 71 in a retracted position. The slip joint 71 may include a tubular mandrel 74 and a tubular housing 75. The mandrel 74 may be longitudinally movable relative to the housing 75 between the extended position and the retracted position. The slip joint 71 may have a longitudinal bore therethrough for passage of the drilling fluid 60*d*. The mandrel 74 may include two or more sections, such as a wash pipe 74*a*, a bumper 74*b*, and a stem 74*c*. The wash pipe 74*a* and the stem 74*c* may be connected together, such by threaded couplings (shown) and/or fasteners (not shown). The bumper 74*b* may be connected to the wash pipe 74*a*, such as such by threaded couplings (shown) and/or fasteners (not shown). The housing 75 may include two or more sections, such as a gland 75*a*, a cylinder 75*b*, a reservoir 75*c*, and an adapter 75*d*, each connected together, such by threaded couplings (shown) and/or fasteners (not shown). The mandrel 74 and housing 75 may be made from a metal or alloy, such as steel, stainless steel, or a nickel based alloy, having strength sufficient to support the drill string lower portion 14*b*, the setting tool 72, and the anchor 73.

The wash pipe 74*a* may also have a threaded coupling formed at an upper end thereof for connection to a bottom of the drill string upper portion 14*u*. The wash pipe 74*a* may also carry a seal 76*b* for sealing an interface between the stem 74*c* and the wash pipe. The housing adapter 75*d* may also have a threaded coupling formed at a lower end thereof for connection to the setting tool 72. The housing adapter 75*d* may also carry a seal 76*d* for sealing an interface between the reservoir 75*c* and the adapter. The housing gland 75*a* may have a recess formed in an inner surface thereof adjacent to an upper end thereof. A wiper 77*w* and a seal stack 77*k* may be disposed in the recess and fastened to the housing gland 75*a*, such as by a snap ring. The seal stack 77*k* may also engage an outer surface of the wash pipe 74*a* to seal a sliding interface between the housing 75 and the mandrel 74. The gland 75*a* may also carry a seal 76*a* for sealing an interface between the cylinder 75*b* and the gland. The cylinder 75*b* may also carry a seal 76*c* for sealing an interface between the reservoir 75*c* and the cylinder.

A torsional coupling, such as spline teeth 78*t* and spline grooves 78*g*, may be formed along a mid and lower portion of the wash pipe 74*a* in an outer surface thereof. A complementary torsional coupling, such as spline teeth 79*t* and spline grooves 79*g*, may be formed in an upper end of the housing cylinder 75*b*. Torsional connection between the housing 75 and the mandrel 74 may be maintained in and between the retracted and the extended positions by the engaged spline couplings 78*t,g*, 79*g,t*.

A bottom face of the housing gland 75*a* may serve as an upper stop shoulder 80*u* and a lower stop shoulder 80*b* may be formed in an inner surface of the housing cylinder 75*b* at a lower portion thereof. A top face of the bumper 74*b* and the upper stop shoulder 80*u* may be engaged when the slip joint 71 is in the extended position and a bottom face of the bumper 76*b* and the lower stop shoulder 80*b* may be engaged when the slip joint 71 is in the retracted position. A lubricant chamber 81*t* may be formed longitudinally between the stop shoulders 80*u,b*. The lubricant chamber 81*t* may be formed radially between an inner surface of the housing cylinder 75*b* and an outer surface of the wash pipe 74*a* and stem 74*c*. Lubricant 82, such as refined oil, synthetic oil, or a blend thereof, may be disposed in the chamber 81*t*. The lubricant chamber 81*t* may be in fluid communication with an upper portion of a balance chamber 81*b* via an annular passage 81*p* formed between the housing cylinder 75*b* and the stem 74*c*.

The balance chamber 81*b* may be formed between a bottom face of the housing cylinder 75*b* and a top face of the housing adapter 75*d*. The balance piston 83 may be disposed in the balance chamber 81*b* and may divide the chamber into the upper portion and a lower portion. The balance piston 83 may carry inner and outer seals for isolating the lubricant from a bore of the slip joint 71. A lower portion of the balance chamber 81*b* may be in fluid communication with the slip joint bore via a bypass 84*b*, such as a slot, formed along an inner surface of the housing adapter 75*d*. Movement of the balance piston 83 within the balance chamber 81*b* may accommodate extension and retraction of the slip joint 71 while maintaining the lubricant 82 at a pressure equal to that of the slip joint bore. The bumper 74*b* may also have a bypass 84*u*, such as a slot formed in an outer surface thereof to ensure that movement of the bumper 74*b* along the lubricant chamber 81*t* is free from damping.

A stroke of the slip joint 71 may correspond to the expected heave of the MODU 1*m*, such as being twice thereof. The drill string compensator 70 may include one or more additional slip joints, if necessary, to obtain the required heave capacity.

Figure 4A:
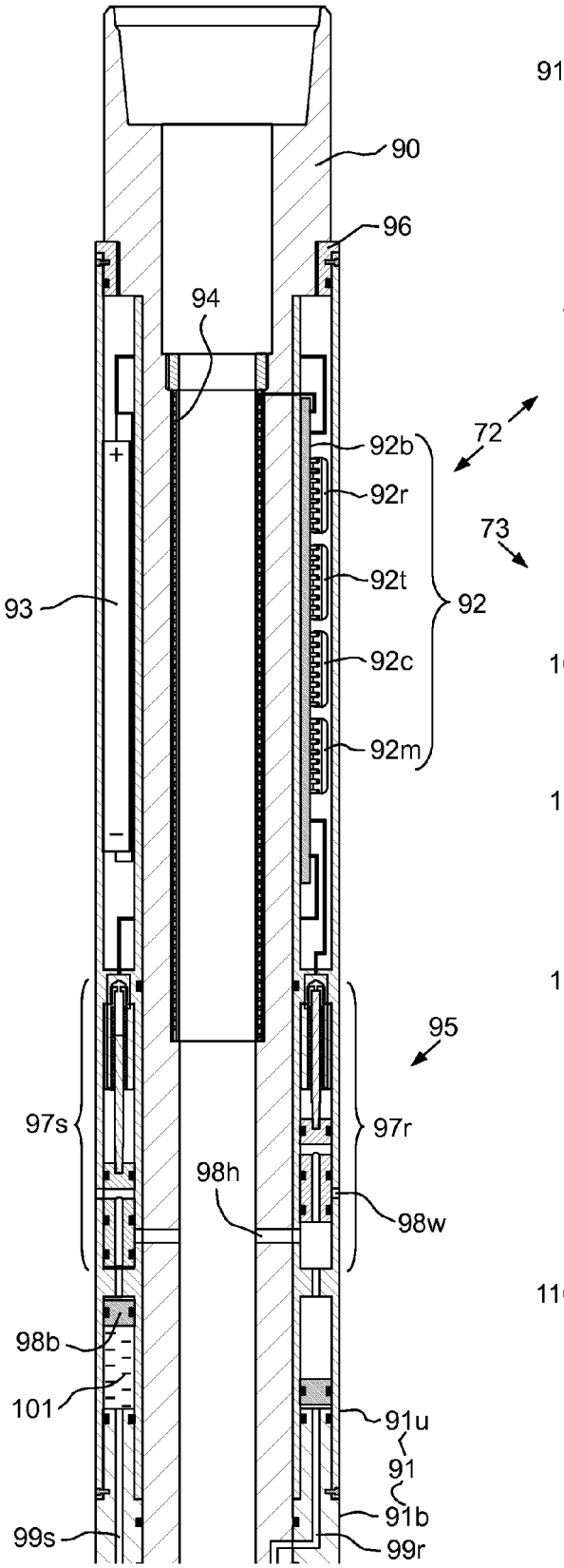
FIGS. 4A and 4B illustrate a setting tool and anchor of the compensator in a released position.
Figure 4B:
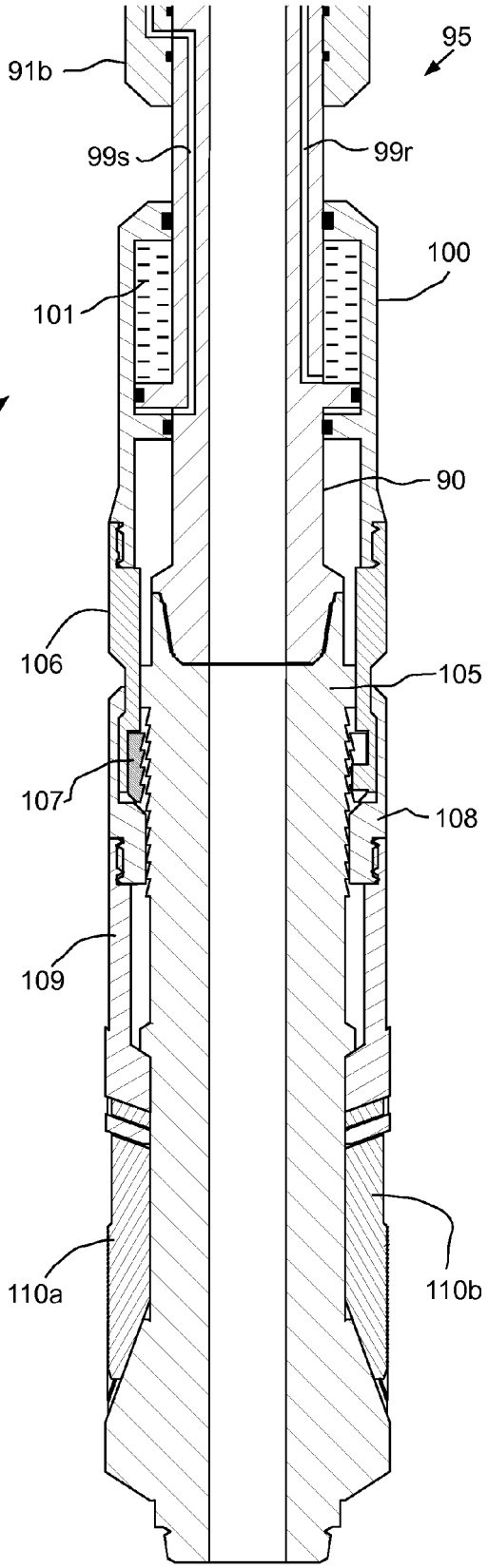
Figure 4C:
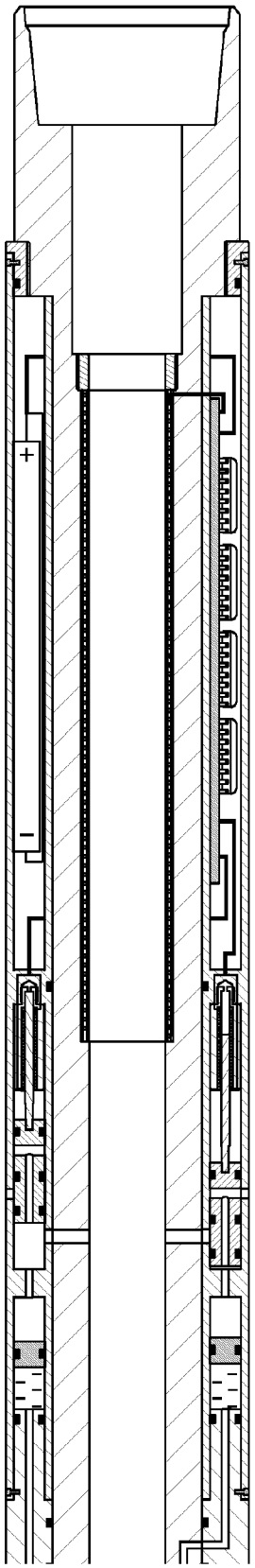
FIGS. 4C and 4D illustrate the setting tool and anchor in a set position.
Figure 4D:
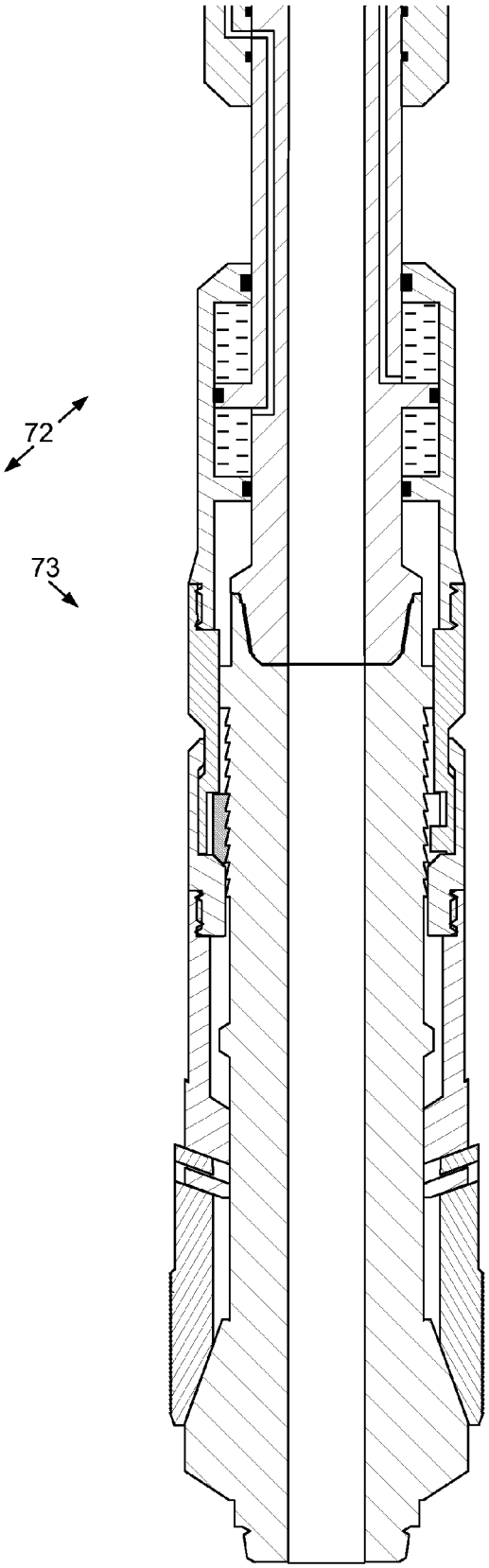

FIGS. 4A and 4B illustrate the setting tool 72 and anchor 73 in a released position. FIGS. 4C and 4D illustrate the setting tool 72 and anchor 73 in a set position. The setting tool 72 may include a mandrel 90, a housing 91, an electronics package 92, a power source, such as a battery 93, an antenna 94, and an actuator 95. The mandrel 90 may be tubular and have threaded couplings formed at longitudinal ends thereof for connection to the slip joint 71 at the upper end and a mandrel 105 of the anchor 73 at the lower end. The housing 91 may include two or more tubular sections 91*u,b* connected to each other, such as by one or more fasteners.

The housing 91 may be disposed around and extend along the mandrel 90. A top of the upper housing section 91*u* may be fastened to the mandrel 90 by a nut 96. The nut 96 may have a threaded inner surface for engagement with a threaded shoulder formed in an outer surface of the mandrel 90. The nut 96 may have a shoulder formed in an outer surface thereof for receiving the top of the upper housing section 91*u* and may carry a seal for sealing an interface between the nut and the upper housing section. A top of the upper housing section 91*u* may be connected to the nut 96, such as by one or more fasteners. The upper housing section 91*u* may have one or more pockets formed between inner and outer walls thereof, such as an electronics pocket, a battery pocket, and one or more (four shown) actuator pockets. The upper housing section 91*u* may carry a seal in an inner surface near a mid portion thereof for sealing an interface formed between the mandrel 90 and the upper housing section.

The antenna 94 may be tubular and extend along a recess formed in an inner surface of the mandrel 90. The antenna 94 may include an inner liner, a coil, and a jacket. The antenna liner may be made from a non-magnetic and non-conductive material, such as a polymer or composite, have a bore formed longitudinally therethrough, and have a helical groove formed in an outer surface thereof. The antenna coil may be wound in the helical groove and made from an electrically conductive material, such as copper or alloy thereof. The antenna jacket may be made from the non-magnetic and non-conductive material and may insulate the coil. The antenna liner may have a flange formed at an upper end thereof and having a threaded outer surface for connection to the mandrel 90 by engagement with a thread formed in an inner surface thereof. Leads may be connected to ends of the antenna coil and extend to the electronics package 92 via conduit formed through a wall of the mandrel 90 and an inner wall of the upper housing section 91*u*.

Leads may be connected to ends of the battery 93 and extend to the electronics package 92 via conduit between the battery pocket and the electronics pocket. The electronics package 92 may include a control circuit 92*c*, a transmitter 92*t*, a receiver 92*r*, and an actuator controller 92*m* integrated on a printed circuit board 92*b*. The control circuit 92*c* may include a microcontroller (MCU), a memory unit (MEM), a clock, and an analog-digital converter. The transmitter 92*t* may include an amplifier (AMP), a modulator (MOD), and an oscillator (OSC). The receiver 92*r* may include an amplifier (AMP), a demodulator (MOD), and a filter (FIL). The actuator controller 92*m* may include a power converter for converting a DC power signal supplied by the battery 93 into a suitable power signal for operating the actuator 95. The electronics package 92 may also be shrouded in an encapsulation (not shown).

The actuator 95 may include a pair of toggle valves 97*r,s*, a pair of balance pistons 98*b*, one or more high pressure ports 98*h*, a pair of low pressure ports 98*w*, a pair of hydraulic passages 99*r,s*, and an actuation piston 100. Each toggle valve 97*r,s* may be disposed in the respective housing valve pocket and have a valve member and a linear actuator for moving the respective valve member between an upper position and a lower position. Each linear actuator may be a solenoid having a shaft connected to the respective valve member, a cylinder connected to the upper housing section 91*u*, and a coil for longitudinally driving the shaft relative to the cylinder between the upper and lower positions. Leads may be connected to ends of each solenoid coil and extend to the electronics package 92 via conduits formed in the upper housing section 91*u*.

Each valve member may carry upper, mid, and lower seals on an outer surface thereof for selectively opening and closing the high 98*h* and respective low 98*w* pressure ports. Each low pressure port 98*w* may be formed through the outer wall of the upper housing section 91*u* to provide fluid communication between the annulus 56 and the respective pocket. Each high pressure port 98*h* may be formed through a wall of the mandrel 90 and an inner wall of the upper housing section 91*u* to provide fluid communication between a bore of the mandrel and the respective valve pocket. A lower end of each valve pocket may be in fluid communication with an upper portion of a respective balance pocket via a passage formed in the upper housing section 91*u*.

A passage may be formed in each valve member. The passage may have a transverse portion formed between the respective upper and mid seals and a longitudinal portion extending from the transverse portion to a lower end of the respective valve member, thereby bypassing the mid and lower seals. The transverse portion may be aligned with the respective low pressure port 98*w* when the valve member is in the lower position, thereby providing fluid communication between the annulus 56 and the balance chamber upper portion. The mid and lower seals of each valve member may also straddle the respective high pressure port 98*h* when the valve member is in the lower position, thereby isolating the balance chamber upper portion from the mandrel bore. Conversely, when each valve member is in the upper position, the respective mid and lower seals may straddle the respective low pressure port 98*w* while the lower end of the valve member is clear of the respective high pressure port 98*h*, thereby providing fluid communication between the mandrel bore and the balance chamber upper portion while isolating the annulus 56 therefrom.

Each balance piston 98*b* may be disposed in the respective balance pocket and may divide the pocket into the upper portion and a lower portion. Hydraulic fluid 101, such as refined oil, synthetic oil, or a blend thereof, may be disposed in the balance pocket lower portions. Each balance piston 98*b* may carry inner and outer seals for isolating the hydraulic fluid from fluid in the respective valve pocket.

A bottom of the upper housing section 91*u* may be connected to a top of the lower upper housing section 91*b* by one or more fasteners. A stab connector may be formed in the top of the lower housing section 91*b* for and be received into each balance pocket and each stab connector may carry a seal for sealing the respective interface therebetween. Each hydraulic passage 99*r,s* may extend from a respective stab connector and continue through a wall of the mandrel 90 via a hydraulic crossover. The hydraulic crossover may include upper, mid, and lower seals carried in an inner surface of the lower housing section for isolating the hydraulic passages 99*r,s* from one another, the annulus 56, and from the high pressure ports 98*h*.

Each hydraulic passage 99*r,s* may continue from the crossover to a respective hydraulic chamber formed between the actuation piston 100 and the mandrel 90. The actuation piston 100 may be longitudinally movable relative to the mandrel between an upper position (FIG. 4B) and a lower position (FIG. 4D, partially lowered). A bulkhead may be formed in an outer surface of the mandrel 90 and the actuation piston 100 may have an upper piston shoulder and a lower piston shoulder straddling the bulkhead. Each of the bulkhead and the piston shoulders may carry a seal for isolating interfaces between the actuation piston 100 and the mandrel 90. An upper release chamber may be formed between the upper piston shoulder and the bulkhead and a lower release chamber may be formed between the lower piston shoulder and the bulkhead. Injection of the hydraulic fluid 101 into the upper release chamber may drive the actuation piston 100 upward along the mandrel 90 to the upper position. Injection of the hydraulic fluid 101 into the lower setting chamber may drive the actuation piston 100 downward along the mandrel until the anchor 73 is set.

The anchor 73 may include a mandrel 105, a ratchet sleeve 106, a ratchet ring 107, a setting sleeve 108, a slip retainer 109, and a plurality of slips 110*a,b*. The mandrel 90 may be tubular and have threaded couplings formed at longitudinal ends thereof for connection to the setting tool mandrel 90 at the upper end and a top of the drill string lower portion 14*b* at the lower end. An upper end of the ratchet sleeve 106 may be connected to a lower end of the actuating piston 100, such as by threaded couplings. The ratchet sleeve 106 may have a groove formed in an inner surface thereof at a lower end thereof for receiving the ratchet ring 107 and a cam pin formed at the lower end and extending into the groove. The ratchet sleeve 106 may also have a groove formed in an outer surface thereof for receiving a lug formed in an inner surface of the setting sleeve 108 at an upper end thereof. The groove may be larger than the lug, thereby linking the ratchet sleeve 106 and the setting sleeve 108 longitudinally while allowing limited freedom for longitudinal movement relative thereto to accommodate operation of the ratchet ring 107.

The ratchet ring 107 may be a split ring having ratchet teeth formed in an inner surface thereof. The ratchet ring 107 may be naturally biased inward toward an engaged position with complementary ratchet teeth formed in an outer surface of the anchor mandrel 105. Split faces of the ratchet ring 107 may be engaged with the cam pin of the ratchet sleeve 106 such that upward movement of the cam pin relative to the ratchet ring 107 forces the split faces thereof apart, thereby expanding the ratchet ring outward from engagement with the ratchet profile of the anchor mandrel 105 and against the natural bias thereof.

The ratchet ring 107 may be trapped between a shoulder formed in an inner surface of the ratchet sleeve 106 and a ratchet shoulder formed in an inner surface of the setting sleeve 108. Downward movement of the ratchet sleeve 106 relative to the ratchet ring 107 allows the split faces to move together into the engaged position, thereby linking the setting sleeve 108 to the anchor mandrel 105 in such fashion as to allow relative downward movement of the setting sleeve 108 relative to the anchor mandrel and to prevent upward movement of the setting sleeve 108 relative to the anchor mandrel. Downward movement of the ratchet sleeve 106 also engages a bottom face thereof with a setting shoulder formed in an inner surface of the setting sleeve 108, thereby also pushing the setting sleeve downward.

An upper end of the slip retainer 109 may be connected to a lower end of the setting sleeve 108, such as by threaded couplings. The slip retainer 109 may be tubular and extend along an outer surface of the anchor mandrel 105. The slip retainer 109 may have a stop shoulder formed in an inner surface thereof and the anchor mandrel 105 may have a complementary stop shoulder formed in an outer surface thereof, thereby linking the slip retainer and the anchor mandrel longitudinally while allowing limited freedom for longitudinal movement relative thereto to accommodate operation of the slips 110*a,b*.

The slip retainer 109 may be connected to upper portions of each of the slips 110*a,b*, such as by a flanged (i.e., T-flange and T-slot) connection. Each flanged connection may have inclined surfaces to facilitate extension and retraction of the slips 110*a,b*. Each slip 110*a,b* may be radially movable between an extended position and a retracted position by longitudinal movement of the slip retainer 109 and setting sleeve 108 relative to the slips 110*a,b*. A slip receptacle may be formed in an outer surface of the anchor mandrel 105 for each slip 110*a,b*. Each slip receptacle may include a pocket for receiving a lower portion of the respective slip 110*a,b*. The anchor mandrel 105 may be connected to lower portions of the slips 110*a,b* by reception thereof in the pockets. Each slip pocket may have an inclined surface for extending a respective slip 110*a,b*. A lower portion of each slip 110*a,b* may have an inclined inner surface corresponding to the slip pocket surface.

Downward movement of the slip retainer 109 toward the slips 110*a,b* may push the slips along the inclined surfaces, thereby wedging the lower portions of the slips toward the extended position while interaction between the slips and the slip retainer 109 may wedge the upper portions of the slips toward the extended position. The lower portion of each slip 110*a,b* may also have a guide profile, such as tabs, extending from sides thereof. Each slip pocket may also have a mating guide profile, such as grooves, for retracting the slips 110*a,b* when the slip retainer 109 moves longitudinally upward away from the slips. Each slip 110*a,b* may have teeth formed along an outer surface thereof. The teeth may be made from a hard material, such as tool steel, ceramic, or cermet for engaging and penetrating an inner surface of the casing 52, thereby anchoring the slips 110*a,b* to the casing.

Figure 5A:
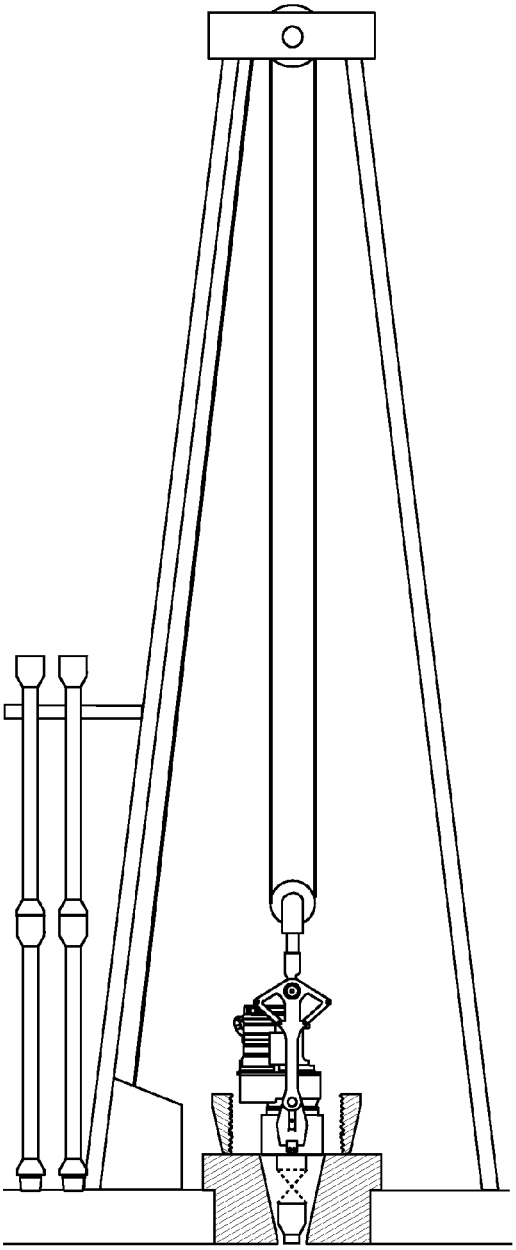
FIGS. 5A-5F illustrate shifting of the compensator from the idle mode to an operational mode.
Figure 5B:
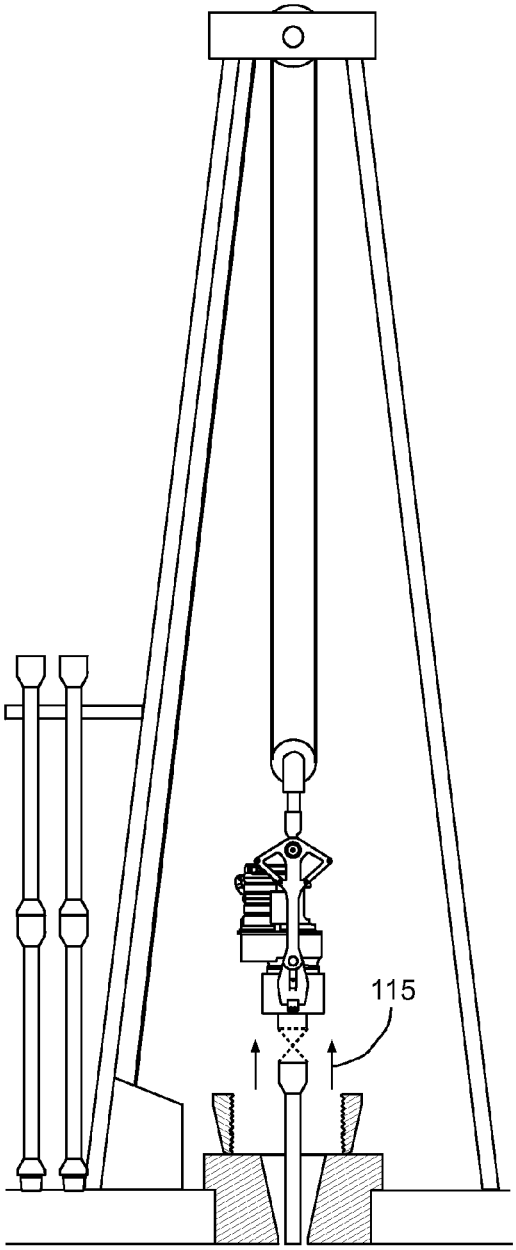
Figure 5C:
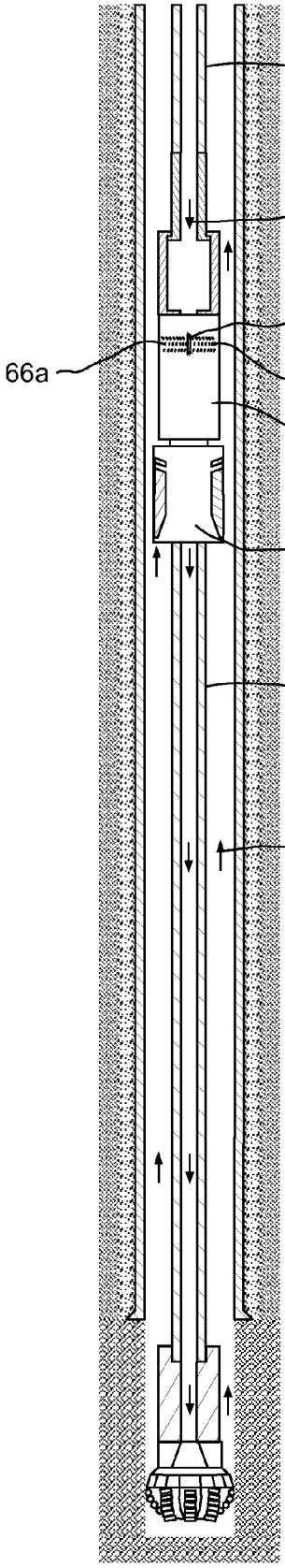

FIGS. 5A-5F illustrate shifting of the compensator 70 from the idle mode to an operational mode. Referring specifically to FIG. 5A, during drilling of the wellbore 55, once a top of the drill string 10 reaches the rig floor 4, the drill string may then require extension to continue drilling. Drilling may be halted by stopping advancement 16*a* and rotation 16*r* of the top drive 5. Referring specifically to FIG. 5B, the drill string 10 may then be raised 115 to lift the drill bit 15 off a bottom of the wellbore 55. Referring specifically to FIG. 5C, the first tag launcher 610 may then be operated to launch the first tag 62*o* into the supply line 37*s*. The drilling fluid 60*d* may propel the first tag 62*o* down the drill string 10 to the setting tool 72. The first tag 62*o* may transmit the command signal 66*c* to the antenna 94 as the tag passes thereby.

Figure 5D:
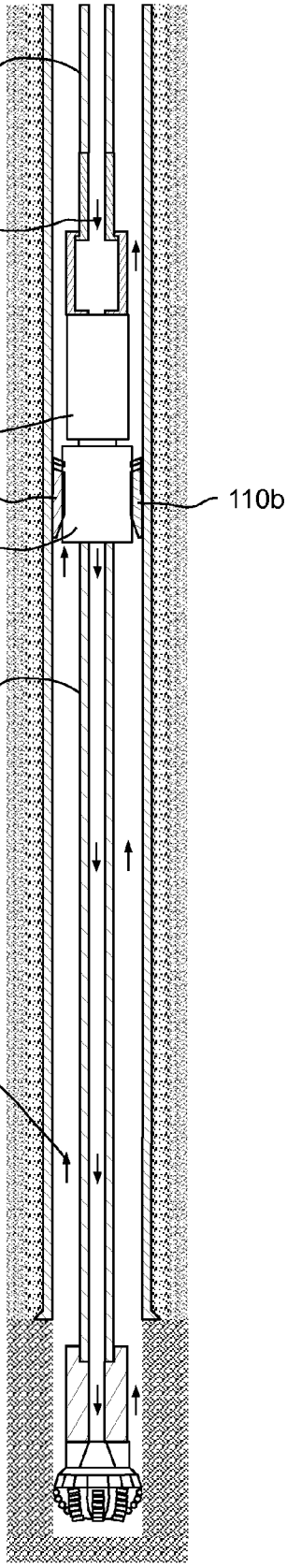

Referring specifically to FIG. 5D, the MCU may receive the command signal 66*c* from the antenna 94 and operate the actuator controller 92*m* to energize the solenoids of the toggle valves 97*r,s*, thereby moving the setting valve 97*s* to the upper position and the release valve 97*r* to the lower position. Due to a pressure differential across the drill bit 15, the bore pressure of the drill string may be substantially greater than the annulus pressure. The pressurized drilling fluid 60*d* may flow into the setting balance piston pocket via the respective high pressure port 98*h* thereby pushing the respective balance piston downward along the balance pocket. The hydraulic fluid 101 may be driven into the setting chamber via the setting passage 99*s*, thereby forcing the actuation piston 100 downward until the slips 110*a,b* are set against the inner surface of the casing 52. The hydraulic fluid 101 displaced from the releasing chamber may be exhausted into the releasing balance pocket via the releasing passage 99*r*. The releasing balance piston may discharge any fluid in the upper portion of the chamber into the annulus 56 via the releasing valve member and the respective low pressure port 98*w*. The slips 110*a,b* may be held in the extended position by engagement of the ratchet ring 107 with the anchor mandrel 105 and engagement of the setting sleeve ratchet shoulder with the ratchet ring. Setting of the anchor 73 may support the drill string lower portion from the casing 52.

Figure 5E:
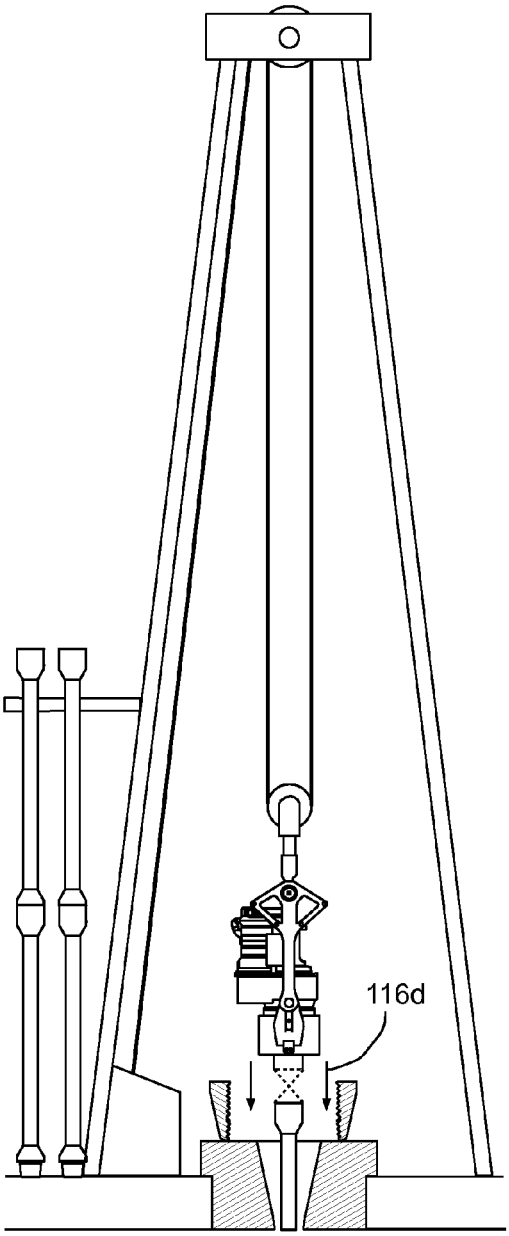
Figure 5F:
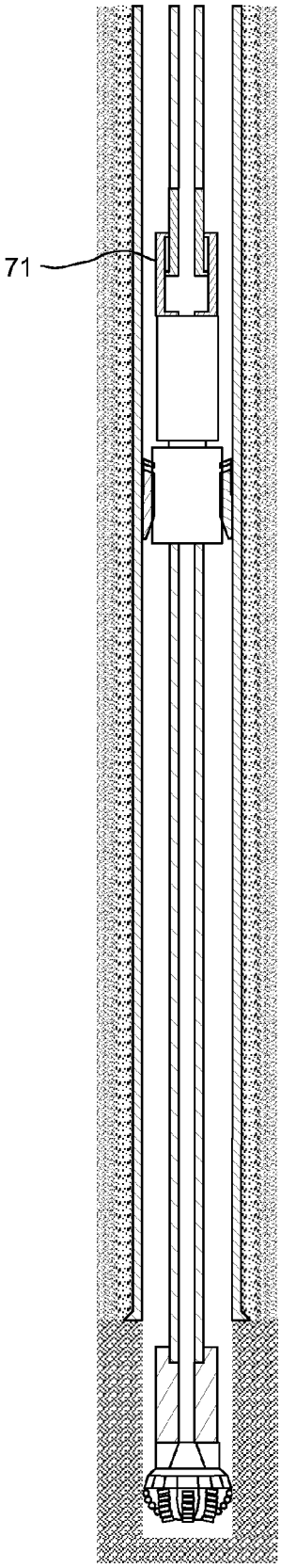

Referring specifically to FIGS. 5E and 5F, once the anchor 73 has been set, circulation of the drilling fluid 60*d* may be halted and the upper portion 14*u* of the drill string 10 lowered 116*d* to shift the slip joint 71 to a mid position. The compensator 70 is now in the operational mode. Setting of the anchor 73 may be verified by reduction in weight exerted on the traveling block 6.

Figure 6A:
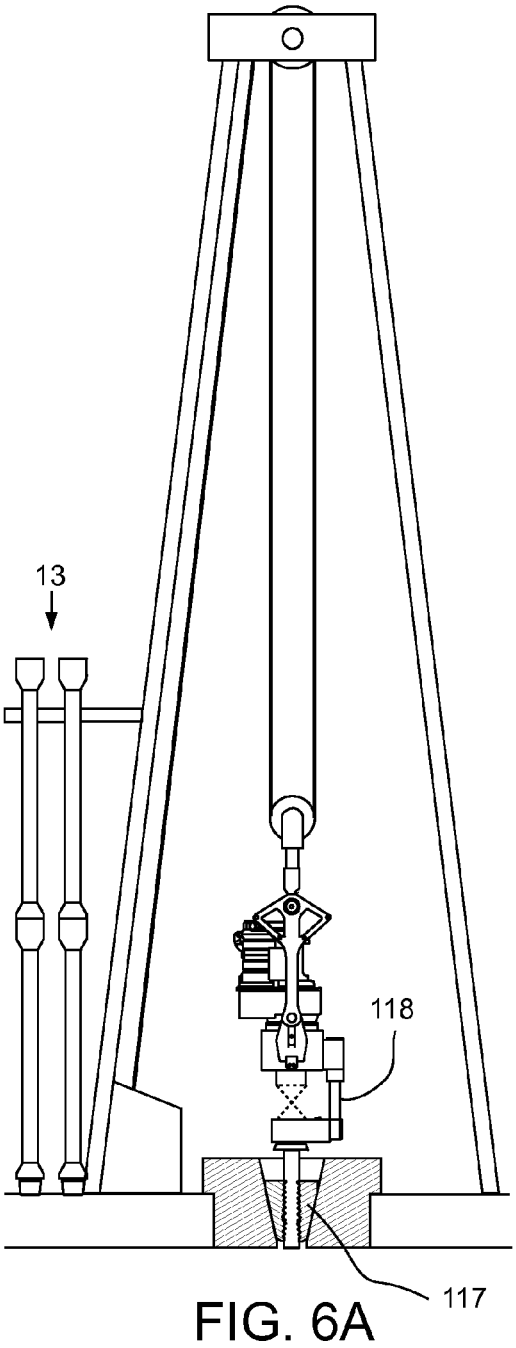
FIGS. 6A-6D illustrate adding a stand of joints to the drill string.

FIGS. 6A-6D illustrate adding a stand 13 of drill pipe joints 10*p* to the drill string 10. Referring specifically to FIG. 6A, a spider 117 may then be operated to engage a top of the drill string upper portion 14*u*, thereby longitudinally supporting the upper portion from the rig floor 4. However, once the upper portion 14*u* is supported from the rig floor 4, the rig compensator 17 can no longer alleviate heaving of the drill string 10 with the MODU 1*m*. However, since the drill string lower portion 14*b* is anchored to the casing 54, the lower portion will not heave and the upper portion 14*u* is free to heave with the MODU due to the presence of the slip joint 71. Heaving of the upper portion 14*u* is inconsequential to the exposed lower formation 54*b*.

An actuator of a backup wrench 118 may be operated to lower a tong of the backup wrench to a position adjacent a top coupling of drill string upper portion 14*u*. A tong actuator of the backup wrench 118 may then be operated to engage the backup wrench tong with the top coupling. The top drive motor may then be operated to loosen and spin the connection between the Kelly valve 11 and the top coupling.

Figure 6B:
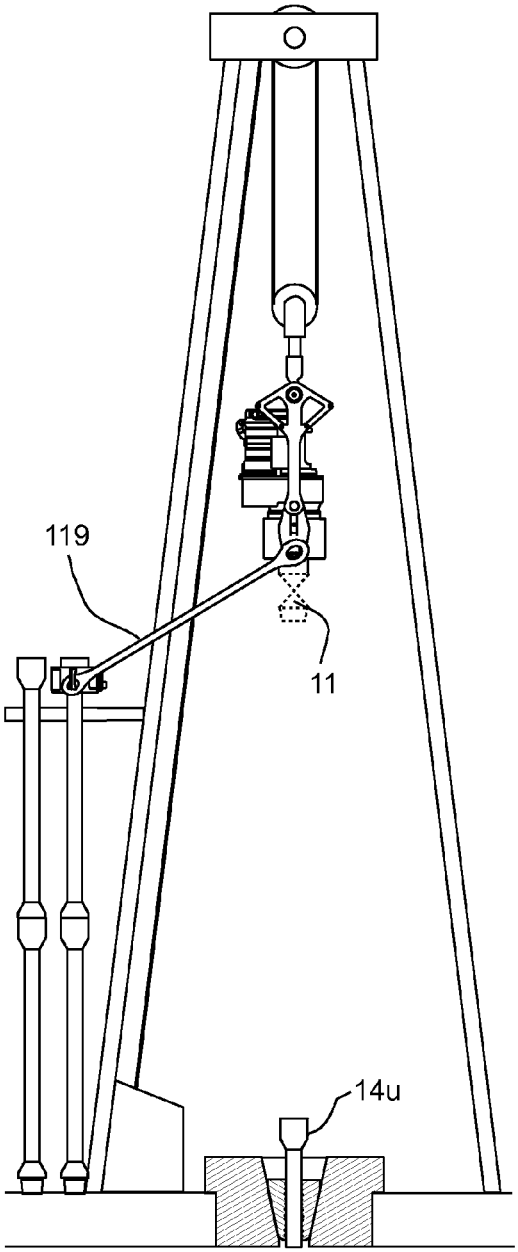

Referring specifically to FIG. 6B, once the connection between the Kelly valve 11 and the top coupling has been unscrewed, the top drive 5 may then be raised by the drawworks 9 until an elevator 119 is proximate to a top of the stand 13. The elevator 119 may be opened (or already open) and a link tilt (not shown) operated to swing the elevator into engagement with the top coupling of the stand 13. The elevator 119 may then be closed to securely grip the stand 13.

Figure 6C:
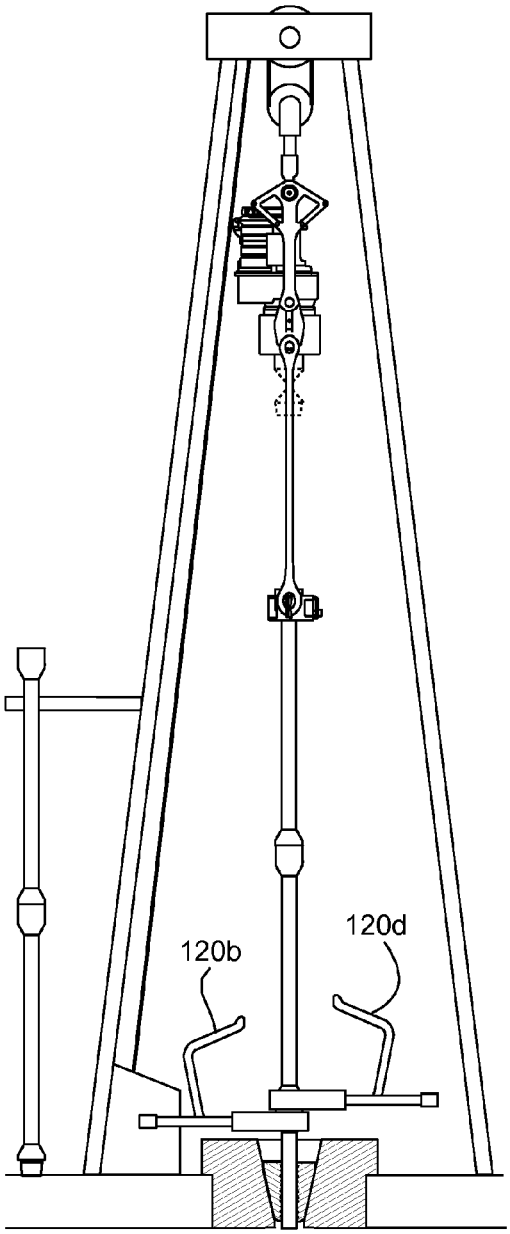

Referring specifically to FIG. 6C, the top drive 5 and stand 13 may then be raised by the drawworks 9 and the link tilt operated to swing the stand over and into alignment with the drill string 10. The top drive 5 and stand 13 may be lowered and a bottom coupling of the stand 13 stabbed into the top coupling of the drill string upper portion 14*u*. A spinner (not shown) may be engaged with the stand 13 and operated to spin the stand relative to the upper portion 14*u*, thereby beginning makeup of the threaded connection. A drive tong 120*d* may be engaged with a bottom coupling of the stand 13 and a backup tong 120*b* may be engaged with a top coupling of the upper portion 14*u*. The drive tong 120*d* may then be operated to tighten the connection between the stand 13 and the upper portion 14*u*, thereby completing makeup of the threaded connection.

Figure 6D:
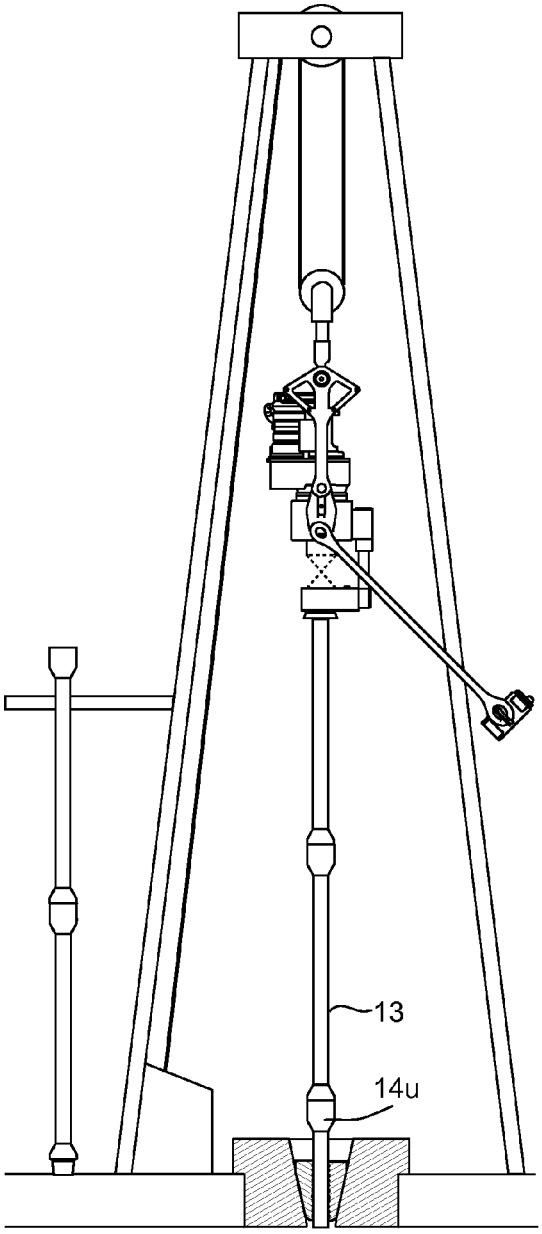

Referring specifically to FIG. 6D, once the connection has been tightened, the tongs 120*b,d* may be disengaged. The elevator 119 may be partially opened to release the stand 13 and the top drive 5 lowered relative to the stand. The backup wrench arm actuator may be operated to lower the backup wrench tong to a position adjacent the top coupling of the stand 13. The backup wrench tong actuator may then be operated to engage the backup wrench tong with the top coupling of the stand 13, the elevator 119 may be fully opened, and the link-tilt operated to clear the elevator. The top drive motor may be operated to spin and tighten the threaded connection between the Kelly valve 11 and the stand 13.

Figure 7A:
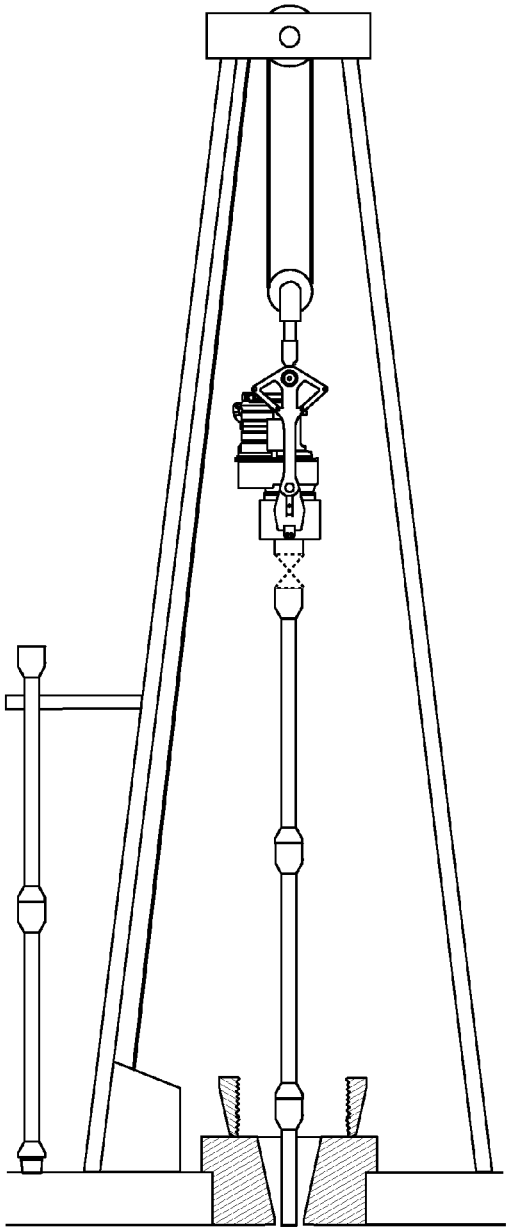
FIGS. 7A-7E illustrate shifting of the compensator from the operational mode back to the idle mode.
Figure 7B:
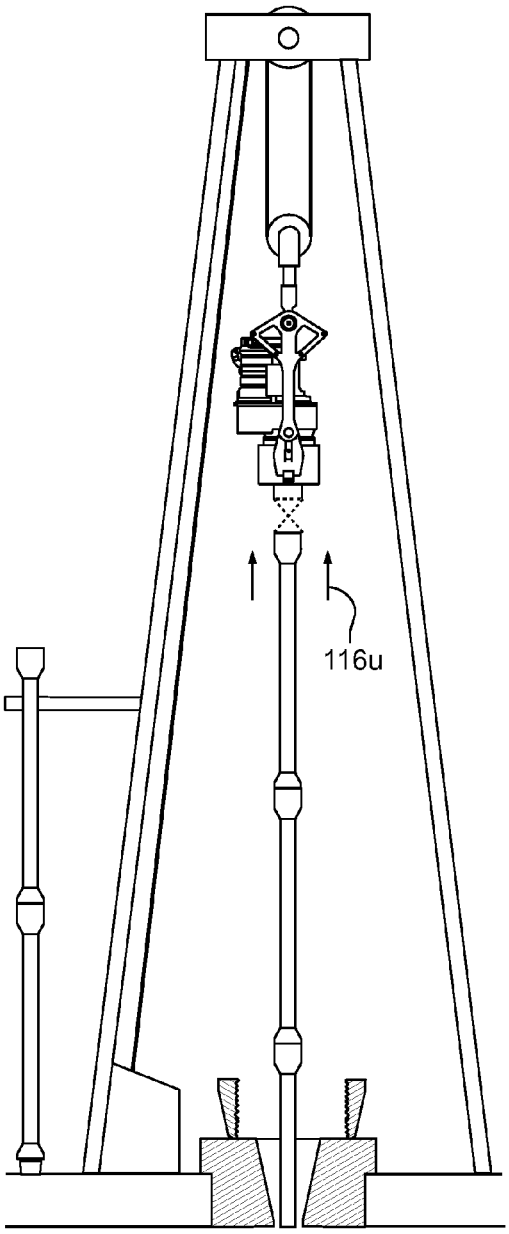
Figure 7C:
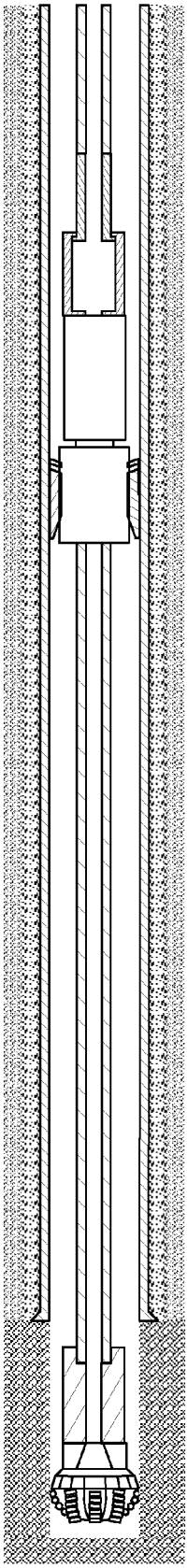
Figure 7D:
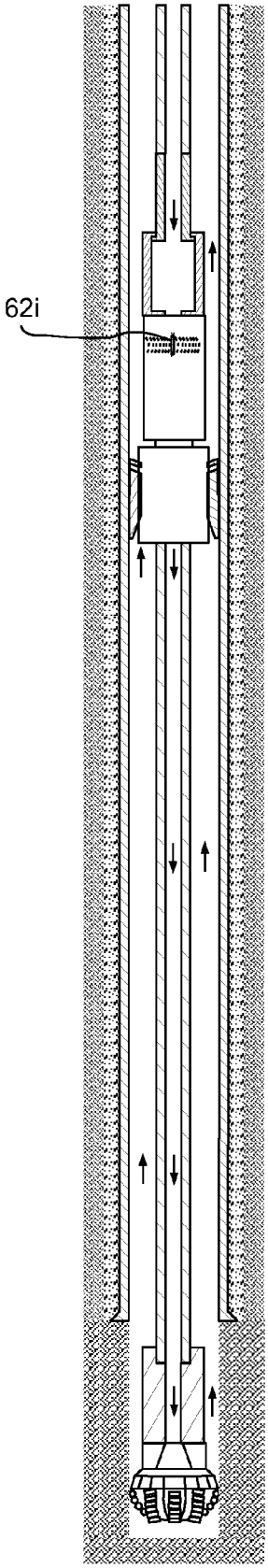

FIGS. 7A-7E illustrate shifting of the compensator from the operational mode back to the idle mode. Referring specifically to FIG. 7A, the spider 117 may then be operated to release the extended drill string upper portion 13, 14*u*. Referring specifically to FIGS. 7B and 7C, once the spider 117 has been released, the extended upper portion 13, 14*u* of the drill string 10 may be raised 116*u* to shift the slip joint 71 back to the extended position. Referring specifically to FIG. 7D, circulation of the drilling fluid 60*d* may resume and the second tag launcher 61*i* may then be operated to launch the second tag 62*i* into the supply line 37*s*. The drilling fluid 60*d* may propel the second tag 62*i* down the drill string 10 to the setting tool 72. The second tag 62*i* may transmit the command signal 66*c* to the antenna 94 as the tag passes thereby.

Figure 7E:
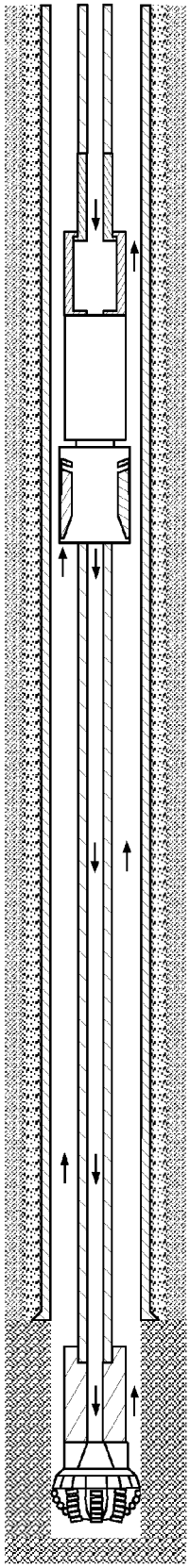

Referring specifically to FIG. 7E, the MCU may receive the command signal from the antenna 94 and operate the actuator controller 92*m* to energize the solenoids of the toggle valves 97*r,s*, thereby moving the setting valve 97*s* to the lower position and the release valve 97*r* to the upper position. The pressurized drilling fluid 60*d* may flow into the releasing balance piston pocket via the respective high pressure port 98*h* thereby pushing the respective balance piston downward along the balance pocket. The hydraulic fluid 101 may be driven into the releasing chamber via the releasing passage 99*r*, thereby forcing the actuation piston 100 upward until the slips 110*a,b* have been retracted from the inner surface of the casing 52. The hydraulic fluid 101 displaced from the setting chamber may be exhausted into the setting balance pocket via the setting passage 99*s*. The setting balance piston may discharge any fluid in the upper portion of the chamber into the annulus 56 via the setting valve member and the respective low pressure port 98*w*.

Figure 7F:
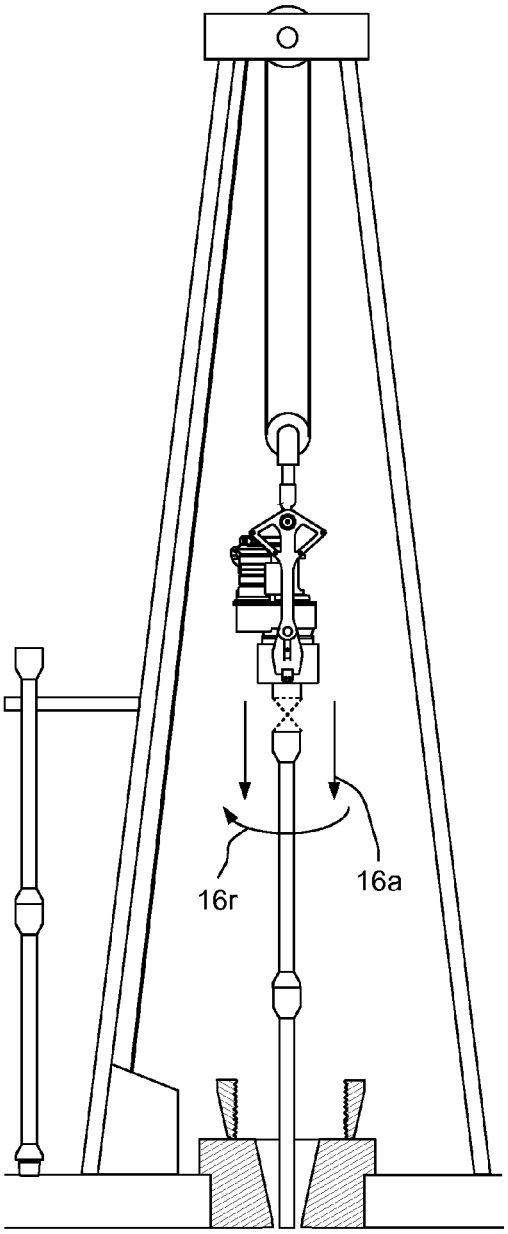
FIG. 7F illustrates resumption of drilling with the extended drill string.

FIG. 7F illustrates resumption of drilling with the extended drill string 10, 13. Drilling of the lower formation 54*b* may resume with the drill string 10 extended by the stand 13.

Figure 8A:
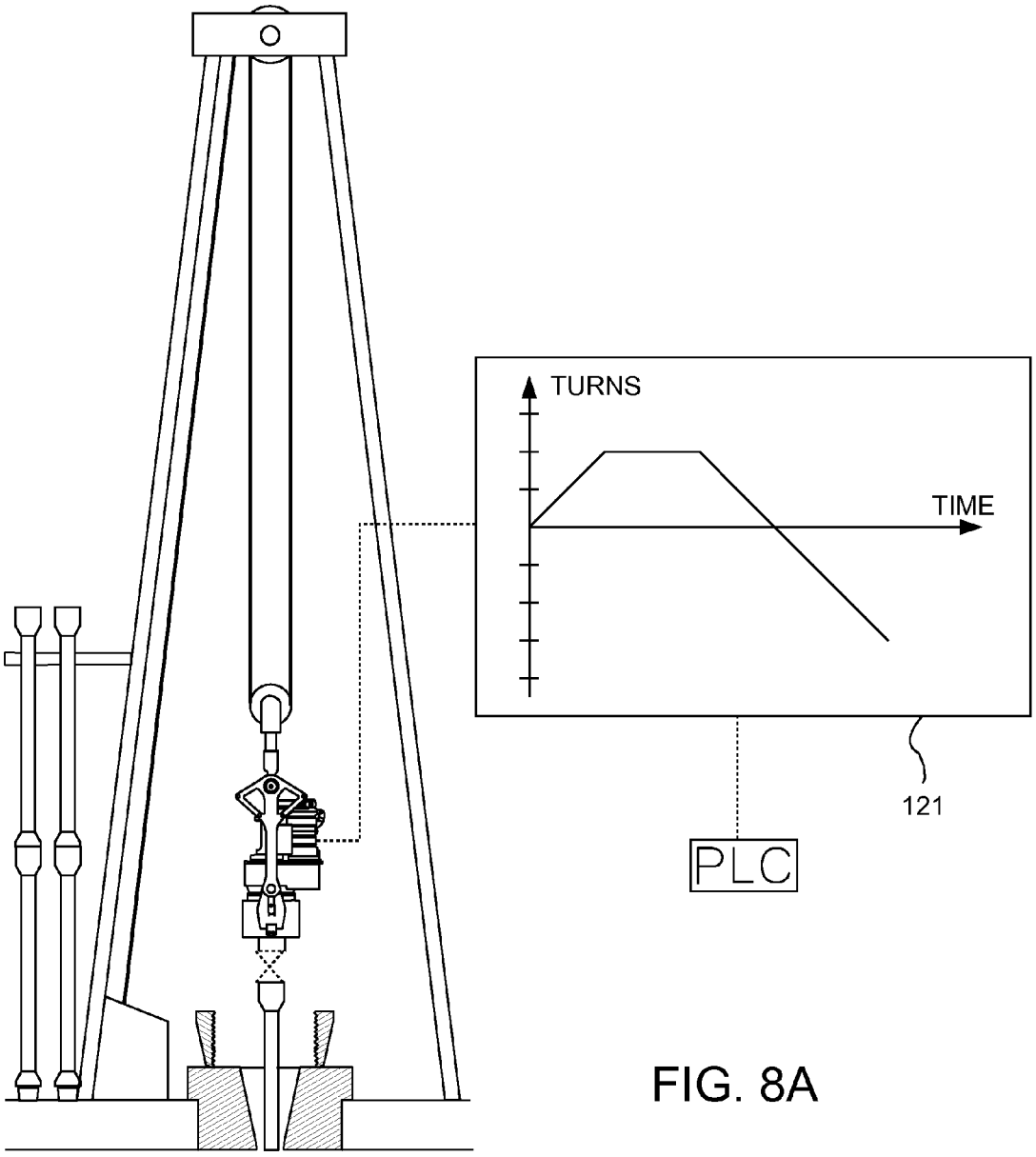
FIGS. 8A and 8B illustrate an alternative telemetry for shifting the compensator between the modes, according to another embodiment of the present disclosure.
Figure 8B:
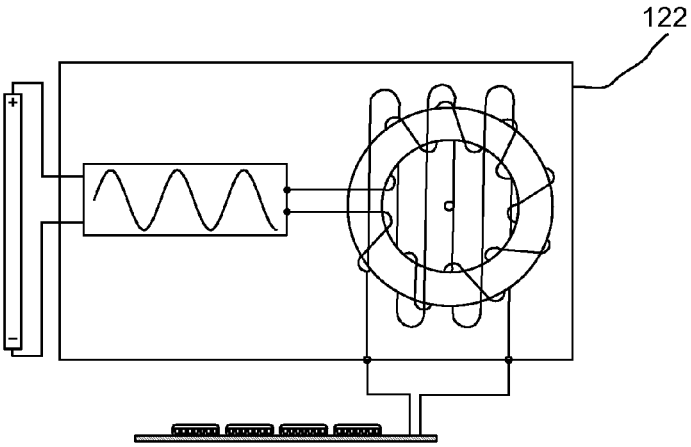

FIGS. 8A and 8B illustrate an alternative telemetry for shifting the compensator 70 between the modes, according to another embodiment of the present disclosure. Instead of or in addition to the antenna 94, transmitter 92*t*, and receiver 92*r*, the electronics package 92 may further include a magnetometer 122 for detecting a command signal 121 sent by modulating rotation of the drill string 10. The protocol may include a series of turns having pauses therebetween. The series of turns may include right hand and left hand turns (shown) or only right hand turns. The same command signal 121 may be used for shifting the compensator from the idle to the operational mode and back or the protocol may further include a second distinct command signal for shifting the compensator from the operational mode to the idle mode. The electronics package may further include second and third magnetometers, each orthogonally arranged relative to the magnetometer 122 to account for deviation in the drill string 10. Alternatively, accelerometers or gyroscopes may be used instead of the magnetometers.

Figure 8C:
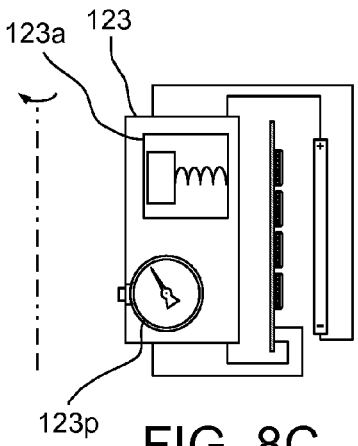
FIG. 8C illustrates a tachometer for the compensator, according to another embodiment of the present disclosure.

FIG. 8C illustrates a tachometer 123 for the compensator, according to another embodiment of the present disclosure. Instead of or in addition to the antenna 94, transmitter 92*t*, and receiver 92*r*, the electronics package 92 may further include the tachometer 123. The tachometer 123 may include an accelerometer 123*a* oriented along a radial axis of the drill string 10 in order to respond to centrifugal acceleration caused by rotation of the drill string. The tachometer 123 may further include a pressure sensor 123*p* in fluid communication with the drill string bore. The tachometer 123 may provide the MCU with the capability of detecting when drilling has ceased by detecting halting of rotation using the accelerometer 123*a* and/or lifting of the drill bit 15 from the wellbore bottom (reduction in pressure differential across the drill bit 15). In this manner, the MCU may automatically shift the compensator from the idle mode to operational mode without requiring a command signal from the MODU 1*m*. The MCU may also use the tachometer to detect when the stand 13 has been added by detecting resumption of circulation and then may automatically shift the compensator back to the idle mode. The tags 62*i,o* (or command signal 121) may be used to activate and deactivate the automatic shifting mode of the MCU.

Additionally, the tachometer 123 may further include second and third accelerometers, each orthogonally arranged relative to the accelerometer 123*a* to account for deviation in the drill string 10. Alternatively, the tachometer may include a differential pressure sensor instead of the pressure sensor 123*p* or a flow meter. Alternatively, the tachometer 123 may be used to detect one or more command signals sent by modulation angular speed of the drill string 10. Alternatively, the pressure sensor may be used to detect one or more command signals sent by mud pulse or flow rate modulation. Alternatively, the setting tool 72 may include a gap sub for detection of one or more command signals sent by electromagnetic telemetry.

Figure 9:
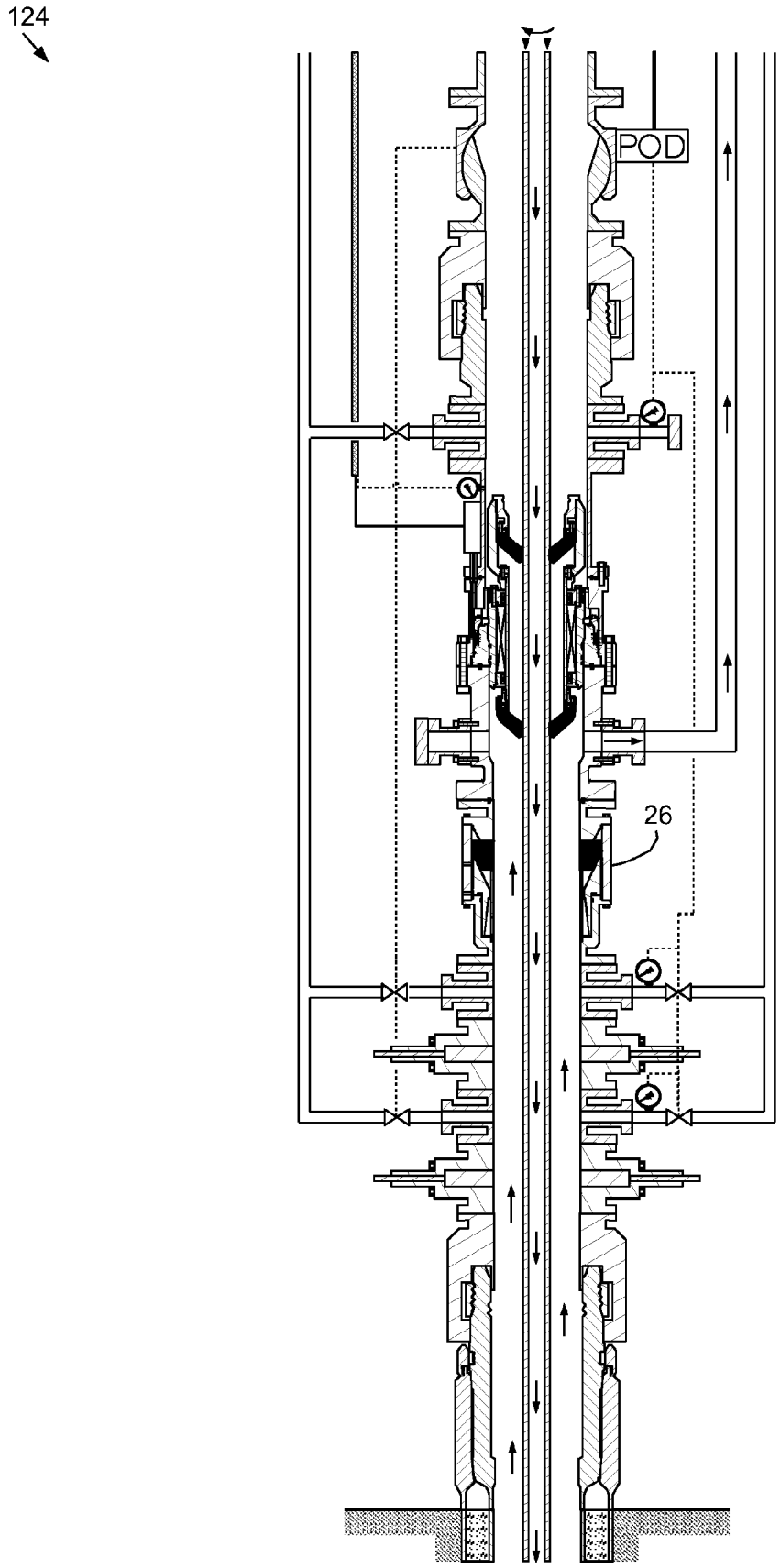
FIG. 9 illustrates an alternative pressure control assembly for the drilling system, according to another embodiment of the present disclosure.

FIG. 9 illustrates an alternative PCA 124 for the drilling system, according to another embodiment of the present disclosure. The alternative PCA 124 may be similar to the PCA 1*p* except that the RCD 26 has been moved from the UMRP 20 to the alternative PCA 124 to alleviate risk of significant gas in the riser causing failure thereof. Operation of the compensator 70 may be the same with the alternative PCA 124. The riser 25 may be filled with seawater or drilling fluid. In a variant of this alternative (not shown), the UMRP, riser, and LMRP may be omitted and the lower formation drilled riserlessly.

Figure 10A:
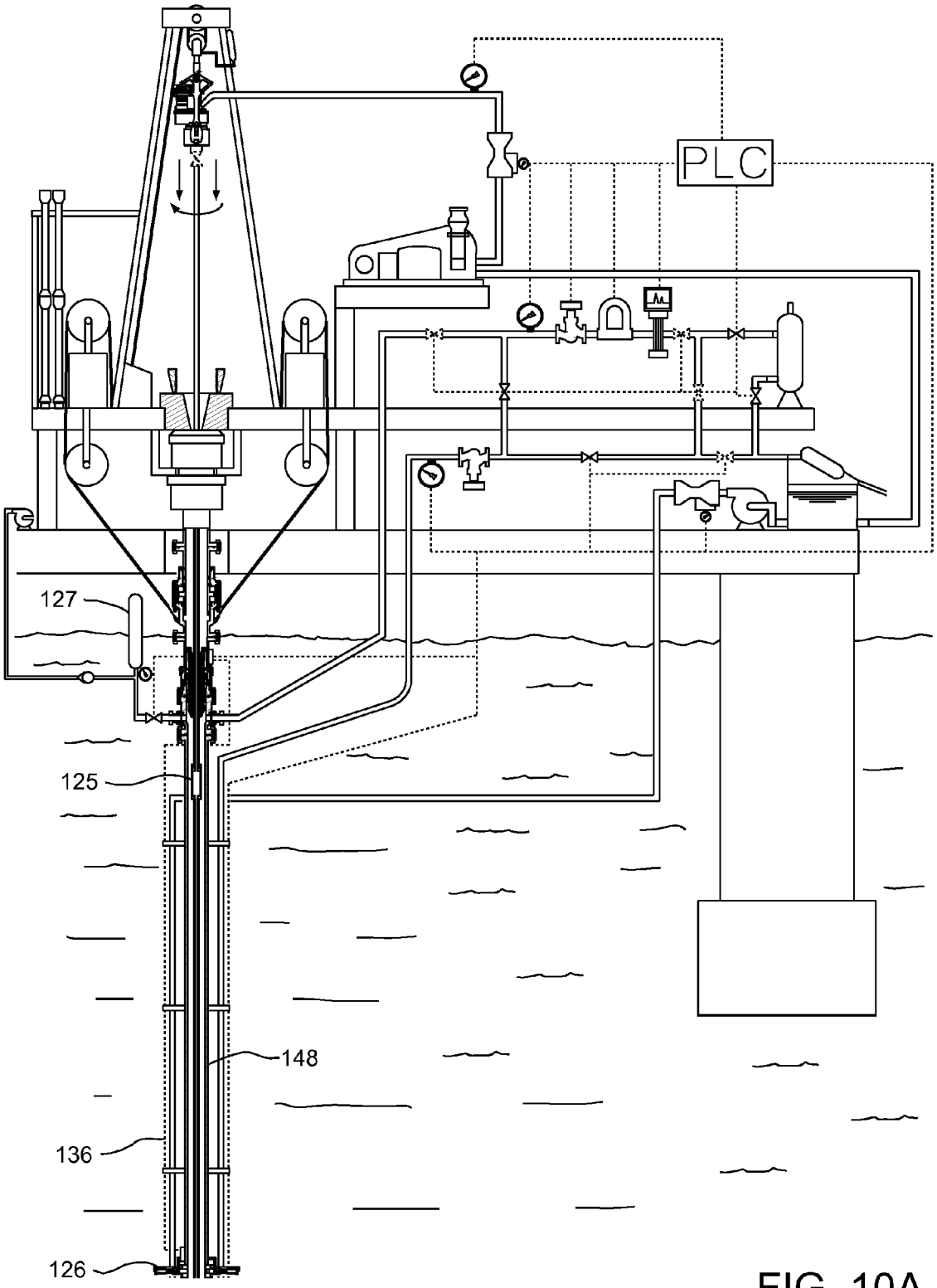
FIG. 10A illustrates the drilling system having an alternative heave compensation system, according to another embodiment of the present disclosure.

FIG. 10A illustrates the drilling system having an alternative heave compensation system, according to another embodiment of the present disclosure. The alternative heave compensation system may include a tensioner 125 assembled as part of the drill string instead of the drill string compensator 70. The alternative heave compensation system may further include a drill string gripper 126 assembled as part of the riser 148 and an accumulator 127 connected to a port of the RCD 26.

Figure 10B:
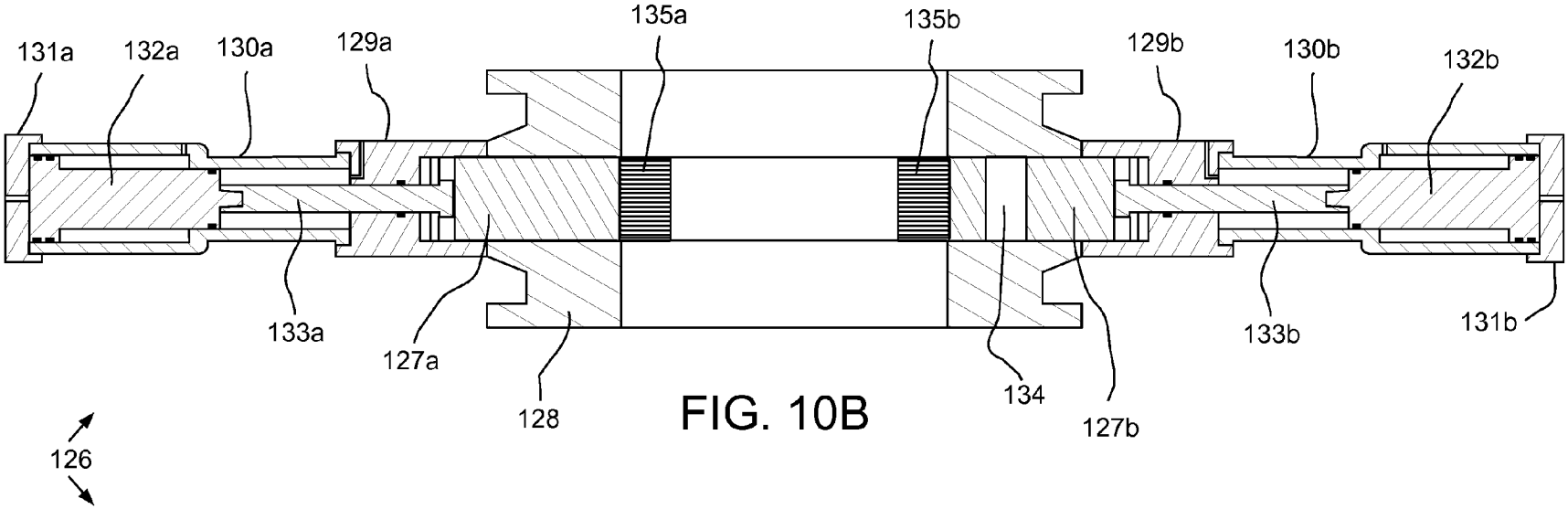
FIG. 10B illustrates a drill string gripper of the alternative system in an engaged position.
Figure 10C:
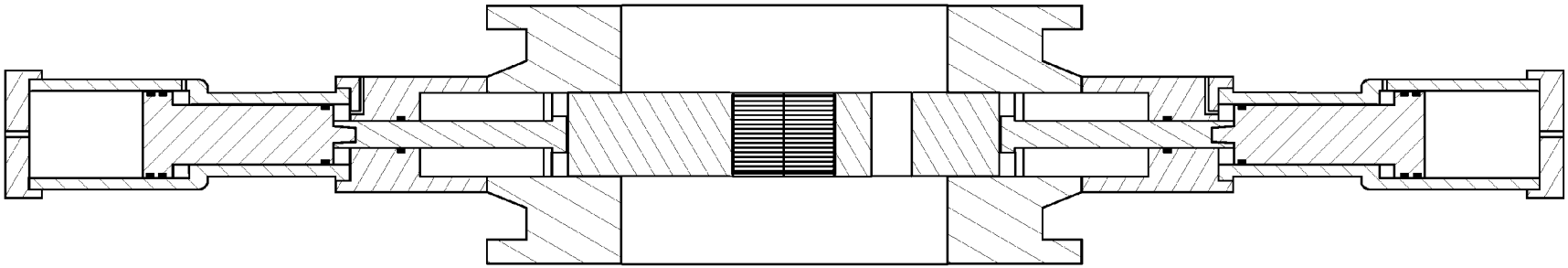
FIG. 10C illustrates the drill string gripper in a disengaged position.

FIG. 10B illustrates the drill string gripper 126 in an engaged position. FIG. 10C illustrates the drill string gripper 126 in a disengaged position. The drill string gripper 126 may include a body 128, two or more opposed rams 127*a,b* disposed within the body, two or more bonnets 129*a,b*, two or more cylinders 130*a,b*, two or more caps 131*a,b*, two or more pistons 132*a,b*, and two or more piston rods 133*a,b*.

The body 128 may have a bore aligned with the wellbore and flanges formed at longitudinal ends thereof for assembly as part of the riser 148. The body 128 may also have a transverse cavity for each ram 127*a,b*, each cavity formed therethrough for receiving the respective ram. The cavities may be opposed, intersect the bore, and support the rams 127*a,b* as they move radially between the engaged and disengaged positions. Each bonnet 129*a,b* may be connected to the body 128, such as by fasteners (not shown), on the outer end of each cavity and may support the respective piston rods 133*a,b*. Each cylinder 130*a,b* may be connected to the respective bonnet 129*a,b*, such as by fasteners (not shown). Each cap 131*a,b* may be connected to the respective bonnet 129*a,b*, such as by fasteners (not shown). Each rod 133*a,b* may be connected to the respective ram 127*a,b*, such as by a retainer and fasteners (not shown). Each rod 133*a,b* may be connected to the respective piston 132*a,b*, such as by threaded couplings.

A push chamber may be formed between each piston 132*a,b* and the respective cap 131*a,b*. Each cap 131*a,b* may have a hydraulic push port formed therethrough. A pull chamber may be formed between each piston 132*a,b* and the respective bonnet 127*a,b*. Each bonnet 127*a,b* may have a hydraulic pull port formed therethrough. An ambient chamber may be formed between each piston 132*a,b* and the respective cylinder 130*a,b*. Each cylinder 130*a,b* may have an ambient port formed therethrough. Each piston 132*a,b* and each bonnet 129*a,b* may carry seals for isolating the respective chambers. Each piston 132*a,b* may be hydraulically operated via a DSG umbilical 136 extending to an HPU on the MODU 1*m* to radially move each ram 127*a,b* between the engaged and disengaged positions by selectively supplying and relieving hydraulic fluid to/from the respective push and pull chambers.

Each ram 127*a,b* may have a semi-annular inner surface complementary to an outer surface of the drill pipe 10*p* and carry a die 135*a,b* having teeth formed along the inner surface thereof. Each die 135*a,b* may be fastened to the respective ram 127*a,b*. Each die 135*a,b* may be made from a hard material, such as tool steel, ceramic, or cermet for engaging and penetrating an inner surface of the drill pipe 10*p*, thereby anchoring the drill string lower portion 147*b* to the riser 148. The drill string gripper 126 may further have one or more bypass ports 134 formed longitudinally through one or more of the rams 127*a,b* such that fluid communication through the annulus is maintained when the rams are engaged with the drill string.

Additionally, the alternative heave compensation system may include a second drill string gripper (not shown) spaced apart from the drill string gripper along the riser such that if couplings of the drill string are aligned with the one of the grippers, drill pipe will be aligned with the other of the grippers.

Figure 10D:
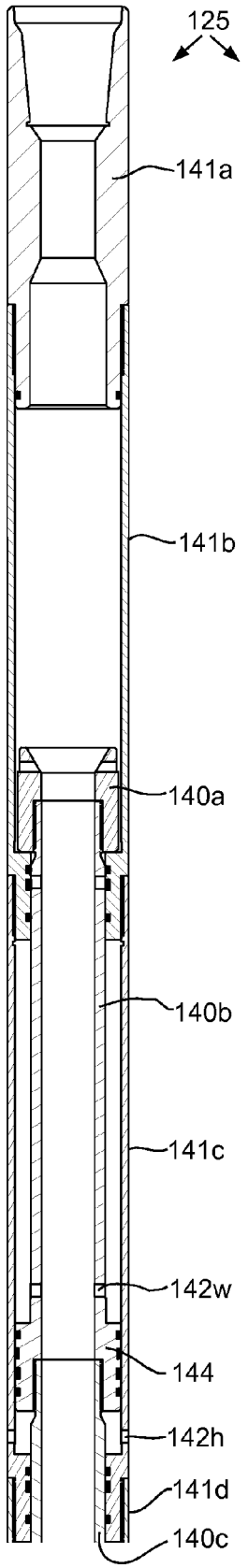
FIGS. 10D and 10E illustrate a tensioner of the alternative system in an extended position.
Figure 10E:
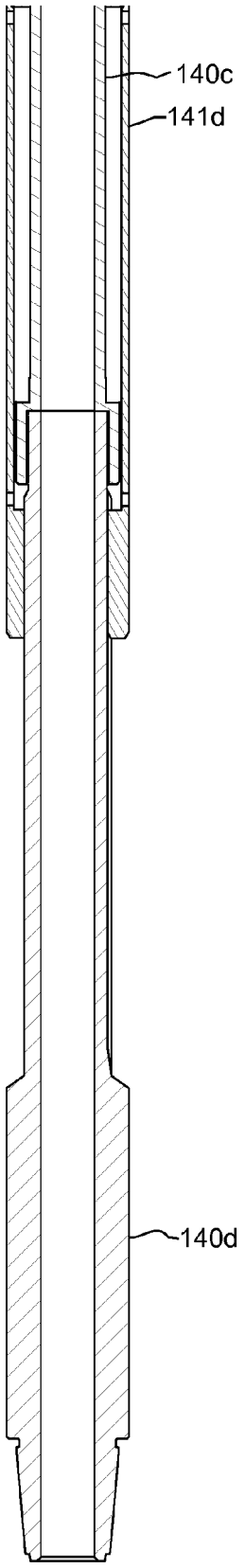
Figure 10F:
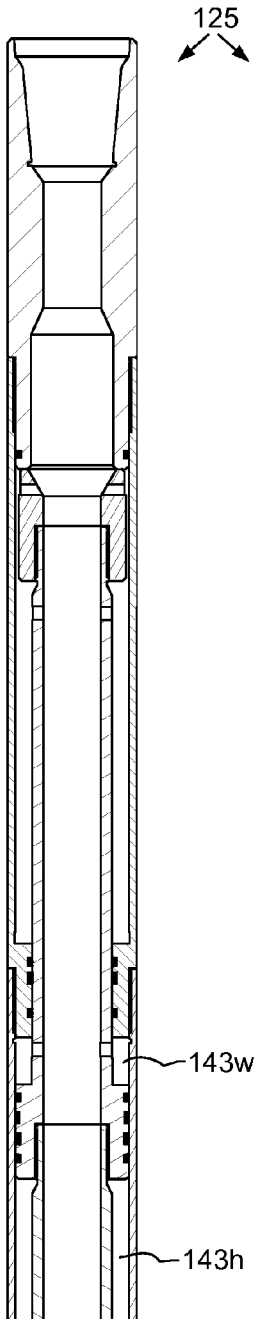
FIGS. 10F and 10G illustrate the tensioner in a retracted position.
Figure 10G:
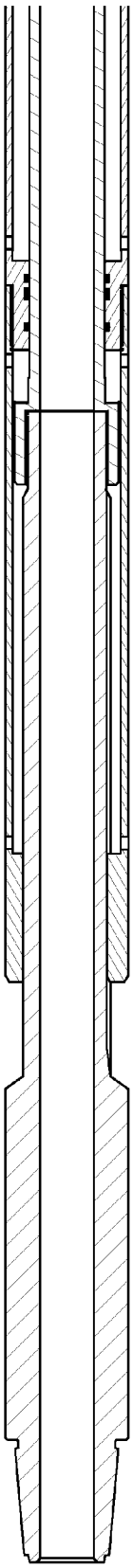

FIGS. 10D and 10E illustrate the tensioner 125 in an extended position. FIGS. 10F and 10G illustrate the tensioner 125 in a retracted position. The tensioner 125 may include a tubular mandrel 140 and a tubular housing 141. The housing 141 may be longitudinally movable relative to the mandrel 140 between the extended position and the retracted position. The tensioner 125 may have a longitudinal bore therethrough for passage of the drilling fluid 60*d*. The mandrel 140 may include two or more sections, such as a bumper 140*a*, piston 140*b*, a spacer 140*c*, and an adapter 140*d*. The mandrel sections 140*a-d* may be connected together, such by threaded couplings (shown) and/or fasteners (not shown). The housing 141 may include two or more sections, such as an adapter 141*a*, a bulkhead 141*b*, a cylinder 141*c*, and a torsion section 141*d*, each connected together, such by threaded couplings (shown) and/or fasteners (not shown). The mandrel 140 and housing 141 may be made from a metal or alloy, such as steel, stainless steel, or a nickel based alloy, having strength sufficient to support the drill string lower portion, the setting tool 72, and the anchor 73.

The housing adapter 141*a* may also have a threaded coupling formed at an upper end thereof for connection to a bottom of the drill string upper portion 147*u*. The housing adapter 141*a* may also carry a seal for sealing an interface between the bulkhead 141*b* and the housing adapter. The mandrel adapter 140*d* may also have a threaded coupling formed at a lower end thereof for connection to a top of a mid portion 147*m* of the drill string. The bulkhead 141*b* may also carry one or more seals and one or more wipers for sealing a sliding interface between the piston 140*b* and the bulkhead. The cylinder 141*c* may also carry one or more seals and one or more wipers for sealing a sliding interface between the spacer 140*c* and the cylinder. A shoulder 144 of the piston 140*b* may also carry one or more seals and one or more wipers for sealing a sliding interface between the cylinder 141*c* and the piston shoulder.

A torsional coupling, such as spline teeth and spline grooves, may be formed along a mid and lower portion of the mandrel adapter 140*d* in an outer surface thereof. A complementary torsional coupling, such as spline teeth and spline grooves, may be formed in a lower end of the torsion section 141*d*. Torsional connection between the housing 141 and the mandrel 140 may be maintained in and between the retracted and the extended positions by the engaged spline couplings.

A bottom face of the housing adapter 141*a* may serve as an upper stop shoulder and a lower stop shoulder may be formed in an inner surface of the bulkhead 141*b* at a lower portion thereof. A bottom face of the bumper 140*a* and the lower stop shoulder may be engaged when the tensioner 125 is in the extended position and an upper face of the bumper 140*a* and the upper stop shoulder 80*b* may be engaged when the tensioner is in the retracted position.

Figure 10H:
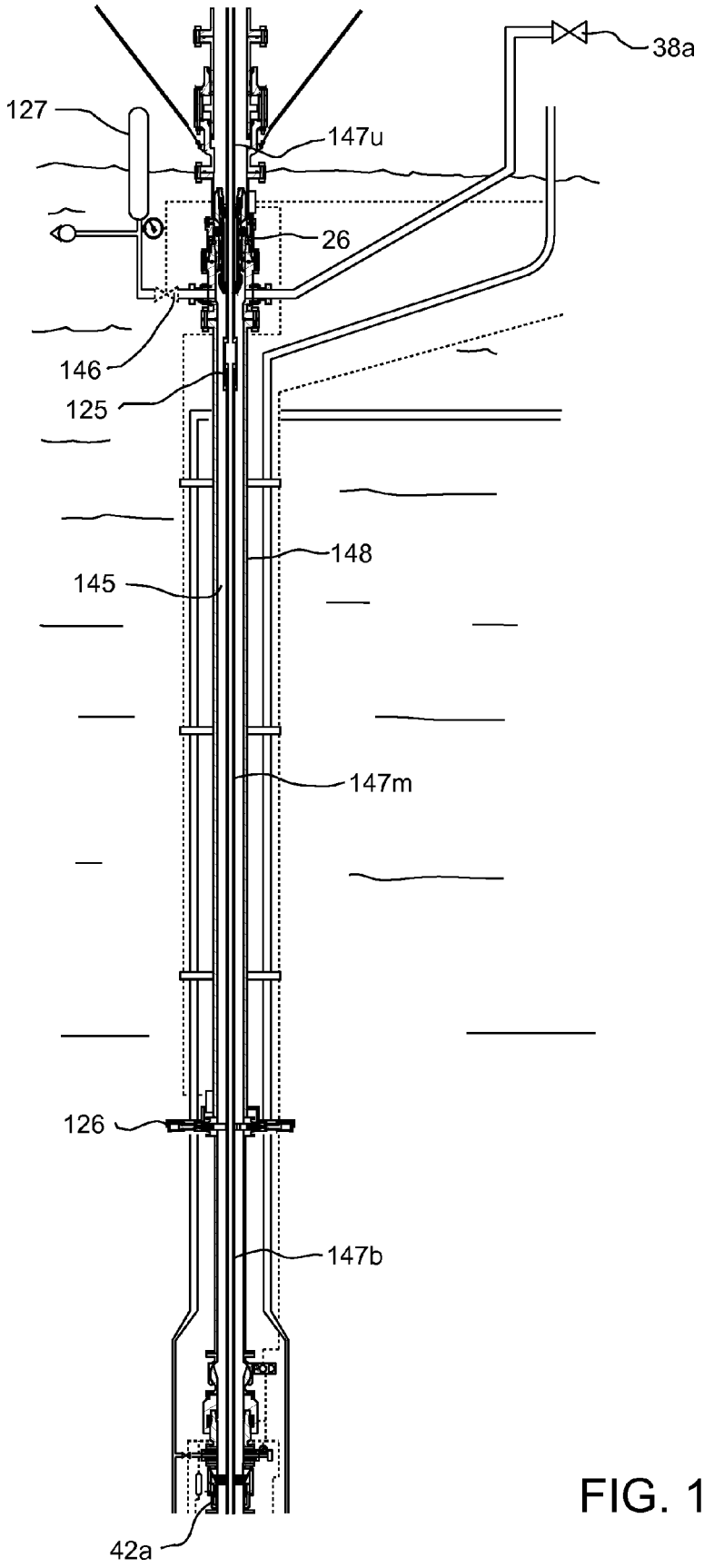
FIG. 10H illustrates the alternative system in an operational mode.

A high pressure chamber 143*h* may be formed longitudinally between a lower face of the piston shoulder 144 and a shoulder formed in an inner surface of the cylinder 141*c* at a lower end thereof. The high pressure chamber 143*h* may be formed radially between an inner surface of the housing cylinder 141*c* and an outer surface of the spacer 140*c*. One or more high pressure ports 142*h* may be formed through a wall of the cylinder 141*c* to provide fluid communication between the high pressure chamber 143*h* and a tensioning chamber 145 (FIG. 10H). A low pressure chamber 143*w* may be formed longitudinally between a lower face of the piston shoulder 144 and a shoulder formed in an inner surface of the bulkhead 141*b* at a lower end thereof. The low pressure chamber 143*w* may be formed radially between an inner surface of the bulkhead 141*b* and an outer surface of the piston 140*b*. One or more low pressure ports 142*w* may be formed through a wall of the piston 140*b* to provide fluid communication between the low pressure chamber 143*w* and the tensioner bore.

A stroke of the tensioner 125 may correspond to the expected heave of the MODU 1*m*, such as being twice thereof. The drill string may include one or more additional tensioners, if necessary, to obtain the required heave capacity.

FIG. 10H illustrates the alternative system in an operational mode. During drilling of the wellbore 55, once a top of the drill string reaches the rig floor 4, the drill string may then require extension to continue drilling. Drilling may be halted by stopping advancement 16*a* and rotation 16*r* of the top drive 5. The drill string may then be raised to lift the drill bit 15 off a bottom of the wellbore 55. The annular BOP 42*a* may then be closed against the drill string and the first shutoff valve 38*a* closed, thereby forming the tensioning chamber 145 longitudinally between the closed annular BOP and the RCD 26 and radially between an outer surface of the drill string and an inner surface of the riser 148. An automated shutoff valve may be opened, thereby providing fluid communication between the accumulator 127 and the tensioning chamber 145. The accumulator 127 may be charged to a pressure corresponding to a tensioning force generated by the tensioner to support the mid portion 147*m* of the drill string formed between the tensioner 125 and the drill string gripper 126. The accumulator may also have a capacity substantially greater than a volume of fluid displaced by the heave such that the accumulator charge pressure remains constant during the heaving.

The drill string gripper 126 may then be engaged with the drill string, thereby anchoring a lower portion 147*b* of the drill string to the riser 148. The drill string may then be lowered to shift the tensioner 125 to a mid position and the spider may be set. Addition of the stand 13 may be the same as discussed above for the compensator 70. The steps may then be reversed to shift the alternative heave compensation system back to the idle mode for the resumption of drilling.

Alternatively, a circulation pump may be connected to the RCD port instead of the accumulator and the MP choke 36*a* used to maintain pressure in the tensioning chamber 145.

Figure 11A:
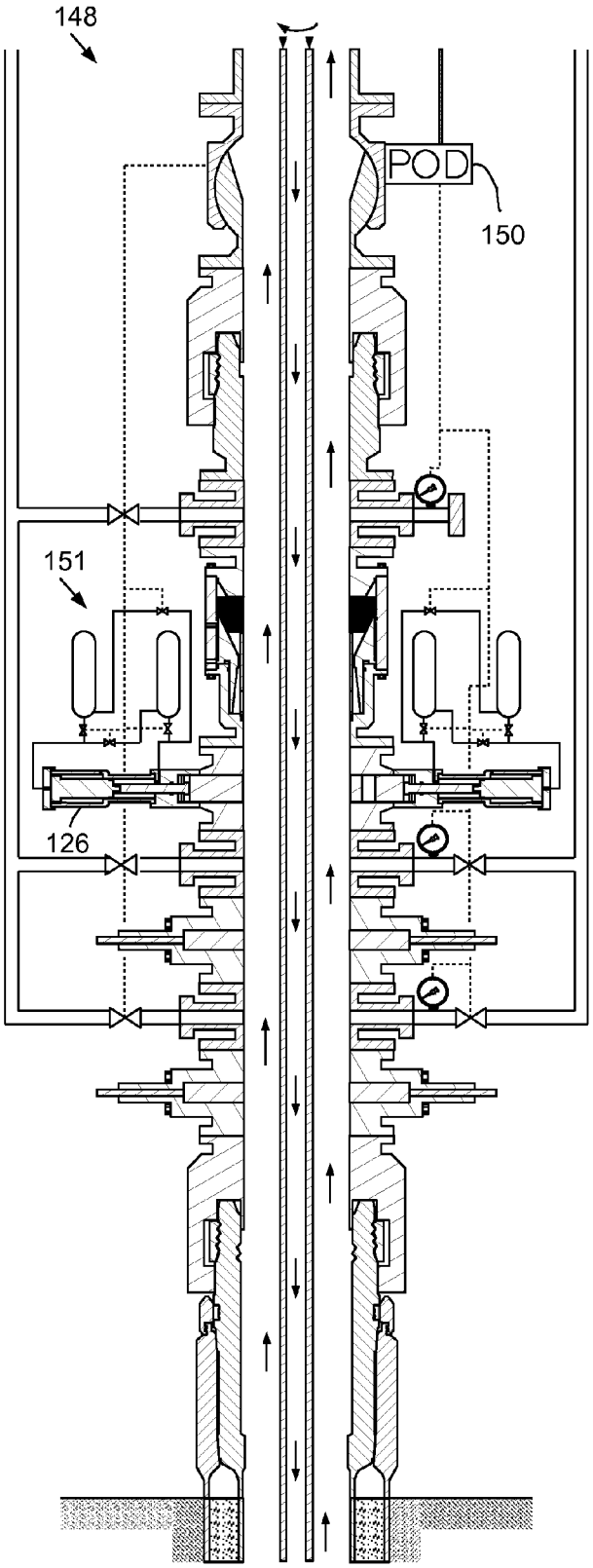
FIGS. 11A and 11B illustrate alternative pressure control assemblies, each having the drill string gripper, according to other embodiments of the present disclosure.
Figure 11B:
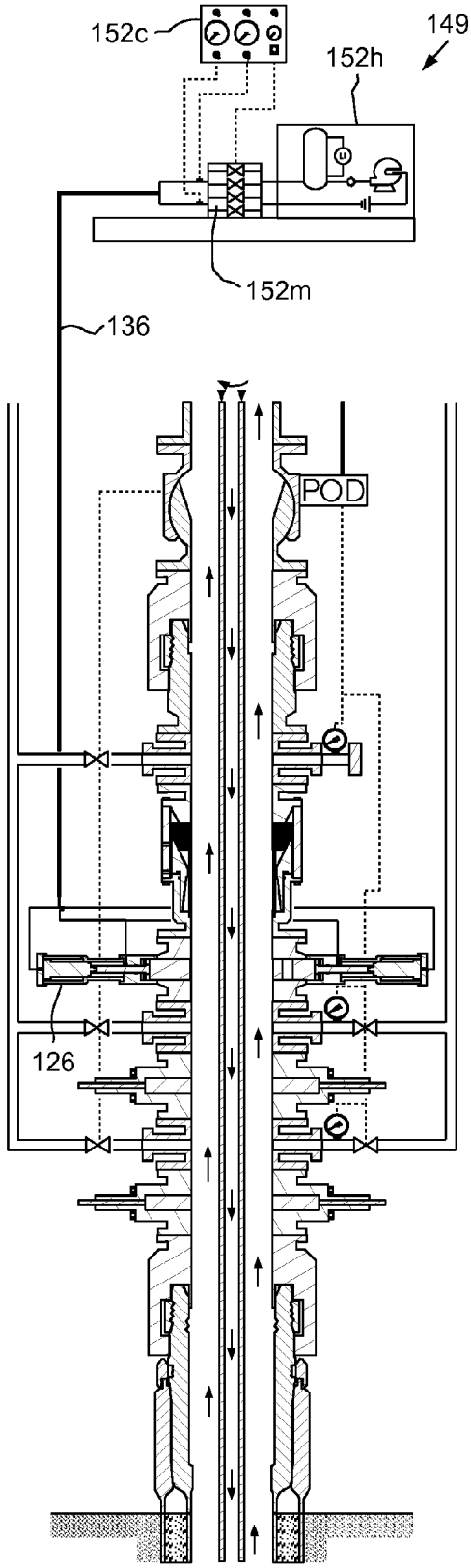

FIGS. 11A and 11B illustrate alternative PCAs 148, 149, each having the drill string gripper 126, according to other embodiments of the present disclosure. Referring specifically to FIG. 11A, the drill string gripper 126 may be assembled as part of the BOP stack and, instead of having a dedicated umbilical 136, the drill string gripper may be operated by the LMRP control pod 150 by inclusion of a hydraulic circuit 151 having accumulators and control valves connected thereto. Referring specifically to FIG. 11B, the drill string gripper 126 may be assembled as part of the BOP stack and have the dedicated umbilical 136 for connection to a control unit onboard the MODU 1*m* having an HPU 152*h*, a manifold 152*m*, and a control console 152*c*. Alternatively, the drill string gripper may be assembled as part of the lower marine riser package.

Figure 12A:
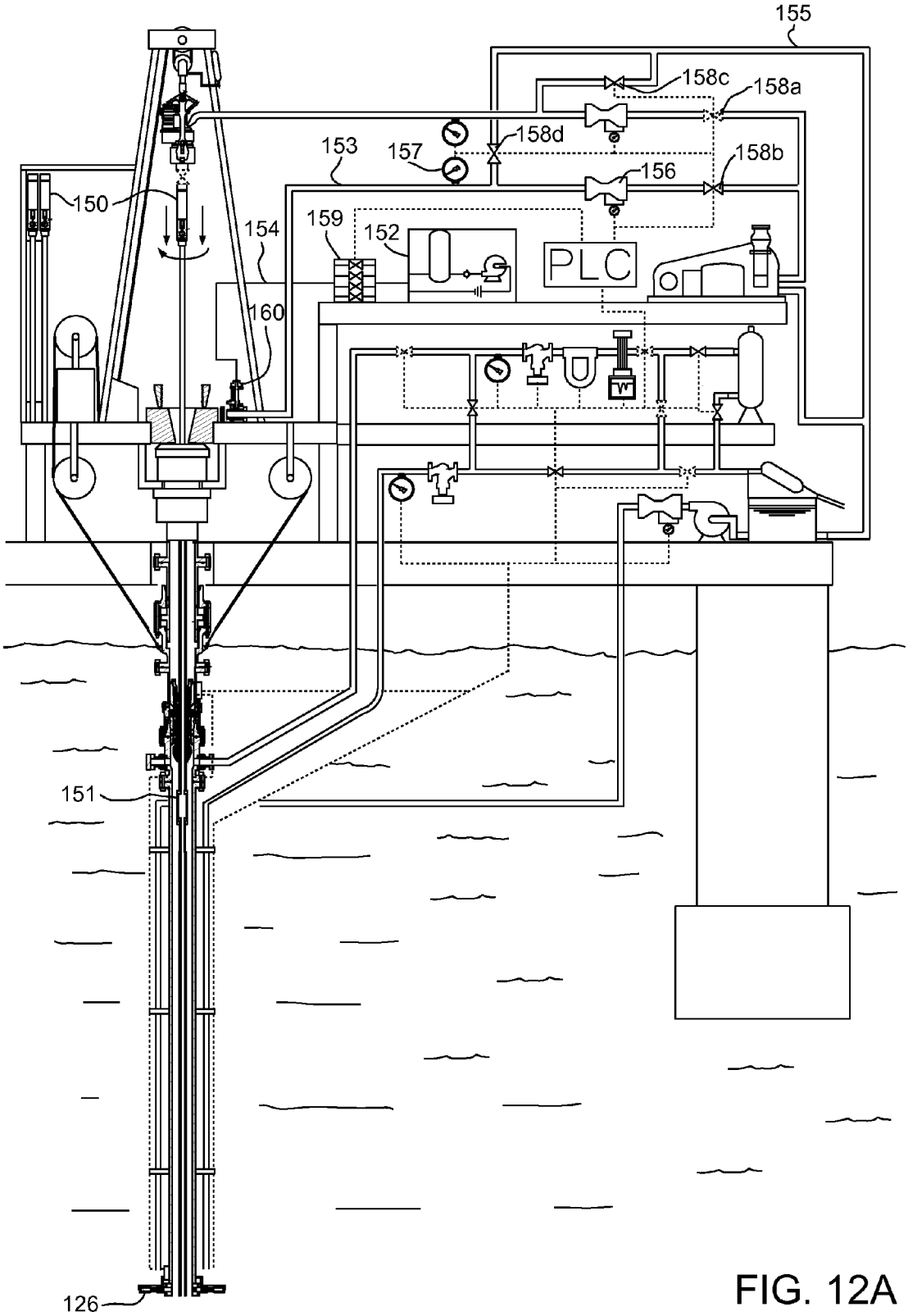
FIG. 12A illustrates the alternative heave compensation system used with a continuous flow drilling system, according to another embodiment of the present disclosure.

FIG. 12A illustrates the alternative heave compensation system used with a continuous flow drilling system, according to another embodiment of the present disclosure. The alternative heave compensation system may be similar to that discussed above with reference to FIG. 10A except for substitution of a bore operated tensioner 151 for the tensioner 125 and addition of a flow sub 150 to the drill string and each of the stands. To operate the flow sub 150, the fluid handling system may further include an HPU 152, a bypass line 153, a hydraulic line 154, a drain line 155, a bypass flow meter 156, a bypass pressure sensor 157, one or more shutoff valves 158*a-d*, a hydraulic manifold 159, and a clamp 160.

A first end of the drain line 155 may be connected to the feed line and a second portion of the drain line may have prongs (two shown). A first drain prong may be connected to the bypass line 153. A second drain prong may be connected to the supply line. The supply drain valve 158*c* and bypass drain valve 158*d* may be assembled as part of the drain line 155. A first end of the hydraulic line 154 may be connected to the HPU 152 and a second end of the hydraulic line may be connected to the clamp 160. The hydraulic manifold 159 may be assembled as part of the hydraulic line 154.

Figure 12B:
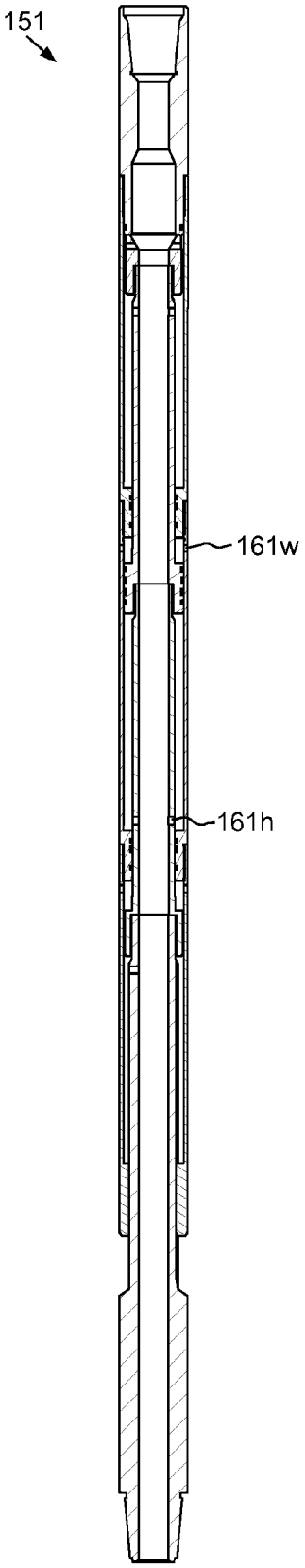
FIG. 12B illustrates the tensioner adapted for operation by the drilling system.

FIG. 12B illustrates the tensioner 151 adapted for operation by the drilling system. The tensioner 151 may be similar to the tensioner 125 except that the high pressure ports 161*h* may be formed through a wall of the mandrel instead of the housing and the low pressure ports 161*w* may be formed through a wall of the housing instead of the mandrel.

Figure 12C:
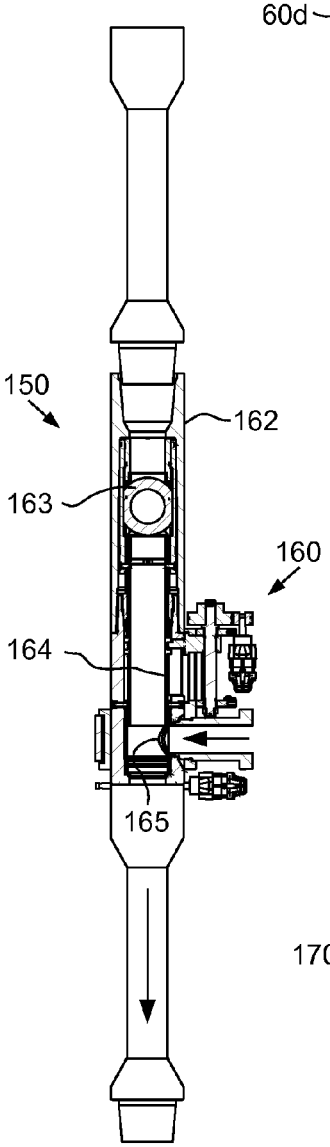
FIG. 12C illustrates the drilling system in a bypass mode.
Figure 12E:
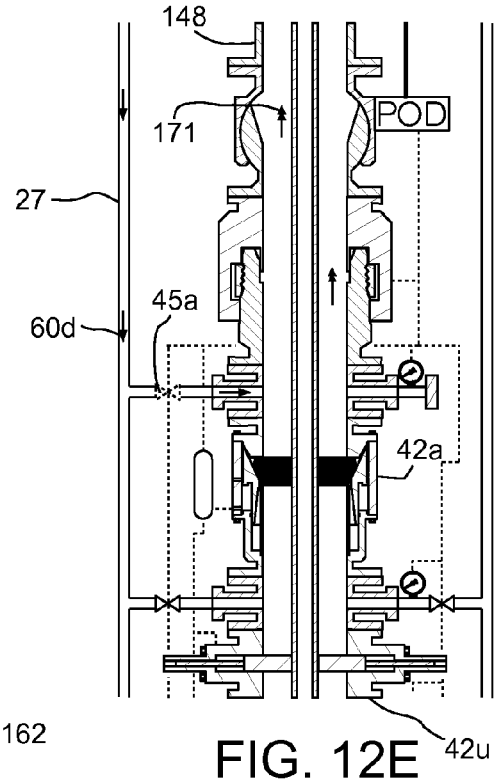
FIGS. 12D and 12E illustrate the drilling system in a degassing mode.

FIG. 12C illustrates the drilling system in a bypass mode. The flow sub 150 may include a tubular housing 162, a bore valve 163, a bore valve actuator, and a side port valve 164. The housing 162 may include one or more sections, such as an upper section and a lower section, each section connected together, such as by threaded couplings. An outer diameter of the housing 162 may correspond to the tool joint diameter of the drill pipe to maintain compatibility with the RCD 26. The housing 162 may have a central longitudinal bore formed therethrough and a radial flow port 165 formed through a wall thereof in fluid communication with the bore (in this mode) and located at a side of the lower housing section. The housing 162 may also have a threaded coupling at each longitudinal end so that the housing may be assembled as part of the drill string. Except for seals and where otherwise specified, the flow sub 150 may be made from a metal or alloy, such as steel, stainless steel, or a nickel based alloy. Seals may be made from an elastomer or elastomeric copolymer.

The bore valve 163 may include a closure member, such as a ball, a seat, and a body, such as a cage. The cage may include one or more sections, such as an upper section and a lower section. The lower cage section may be disposed within the housing 162 and connected thereto, such as by a threaded connection and engagement with a lower shoulder of the housing. The upper cage section may be disposed within the housing 162 and connected thereto, such as by entrapment between the ball and an upper shoulder of the housing.

The ball may be disposed between the cage sections and may be rotatable relative thereto. The ball may be operable between an open position and a closed position by the bore valve actuator. The ball may have a bore formed therethrough corresponding to the housing bore and aligned therewith in the open position. A wall of the ball may close an upper portion of the housing bore in the closed position and the ball may engage the seat seal in response to pressure exerted against the ball by fluid injection into the side port.

The port valve 164 may include a closure member, such as a sleeve, and a seal mandrel. The seal mandrel may be made from an erosion resistant material, such as tool steel, ceramic, or cermet. The seal mandrel may be disposed within the housing 162 and connected thereto, such as by one or more fasteners. The seal mandrel may have a port formed through a wall thereof corresponding to and aligned with the side port. Lower seals may be disposed between the housing 162 and the seal mandrel and between the seal mandrel and the port sleeve to isolate the interfaces thereof.

The port sleeve may be disposed within the housing 162 and longitudinally movable relative thereto between an open position and a closed position by the clamp 160. In the open position, the side port 165 may be in fluid communication with a lower portion of the housing bore. In the closed position, the port sleeve may isolate the side port 165 from the housing bore by engagement with the lower seals of the seal sleeve. The port sleeve may include an upper portion, a lower portion, and a lug disposed between the upper and lower portions.

A window may be formed through a wall of the lower housing section and may extend a length corresponding to a stroke of the port valve 164. The window may be aligned with the side port 165. The lug may be accessible through the window. A recess may be formed in an outer surface of the lower housing section adjacent to the side port for receiving a stab connector formed at an end of an inlet of the clamp 160. Mid seals may be disposed between the housing 162 and the lower cage section and between the lower cage section and the port sleeve to isolate the interfaces thereof.

The bore valve actuator may be mechanical and include a cam, a linkage, and a toggle. An upper annulus may be formed between the cage and the upper housing section and a lower annulus may be formed between the port sleeve and the lower housing section. The cam may be disposed in the upper annulus and may be longitudinally movable relative to the housing 162. The cam may interact with the ball, such as by having one or more (two shown) followers. The ball-cam interaction may rotate the ball between the open and closed positions in response to longitudinal movement of the cam relative to the ball.

The cam may also interact with the port sleeve via the linkage. The linkage may longitudinally connect the cam and the port sleeve after allowing a predetermined amount of longitudinal movement therebetween. A stroke of the cam may be less than a stroke of the port sleeve, such that when coupled with the lag created by the linkage, the bore valve 163 and the port valve 164 may never both be fully closed simultaneously. Upper seals may be disposed between the housing 162 and the cam and between the upper cage section and the cam to isolate the interfaces thereof.

The clamp 160 may include a body, a band, a latch operable to fasten the band to the body, an inlet, one or more actuators, such as port valve actuator and a band actuator, and a hub. The clamp 160 may be movable between an open position for receiving the flow sub 150 and a closed position for surrounding an outer surface of the lower housing segment. The body may have a port formed through a base portion thereof for receiving the inlet. The inlet may be connected to the body, such as by a threaded connection. The inlet may have a coupling, such as flange, for receiving an end of the bypass line 153. The inlet may further have one or more seals and a stab connector formed at an end thereof engaging a seal face of the flow sub 150 adjacent to the side port 165. The port valve actuator may include a stem portion of the body, a bracket, a yoke, a hydraulic motor, and a gear train. The motor may be operable to raise and lower the yoke relative to the body, thereby also operating the port sleeve when the clamp 160 is engaged with the flow sub 150. The band actuator may include a hydraulic motor for tightly engaging the clamp 160 with the lower housing section after the latch has been fastened. The hub may include a hydraulic connector for receiving the hydraulic line 154 from the hydraulic manifold 159.

During drilling of the wellbore 55, once a top of the drill string reaches the rig floor 4, the drill string may then require extension to continue drilling. Drilling may be halted by stopping advancement 16*a* and rotation 16*r* of the top drive 5. The drill string may then be raised to lift the drill bit 15 off a bottom of the wellbore 55. The clamp 160 may then be transported to the flow sub 150 and closed around the flow sub lower housing section. The PLC may then operate the band actuator via the manifold 159, thereby supplying hydraulic fluid to the band motor. Operation of the band motor may tighten the clamp 160 into engagement with the flow sub lower housing.

The PLC may then open the bypass valve 158*b* to pressurize the clamp inlet. The PLC may then operate the port valve actuator via the manifold valves 159, thereby supplying hydraulic fluid to the port motor. Operation of the port motor may raise the yoke, thereby also raising the port sleeve, opening the port valve 164, and closing the bore valve 163. Once the side port 165 is fully open, the PLC may relieve pressure from the top drive 5 by closing the supply valve 158*a* and opening the supply drain valve 158*c*. Drilling fluid 60*d* may be injected into the side port to maintain a pressure corresponding to a tensioning force generated by the tensioner 151 to support the mid portion 147*m* of the drill string.

The drill string gripper 126 may then be engaged with the drill string, thereby anchoring the lower portion 147*b* of the drill string to the riser 148. The drill string may then be lowered to shift the tensioner 125 to a mid position and the spider may be set. Addition of the stand may be the same as discussed above for the compensator 70. The steps may then be reversed to shift the alternative heave compensation system back to the idle mode for the resumption of drilling.

Figure 12F:
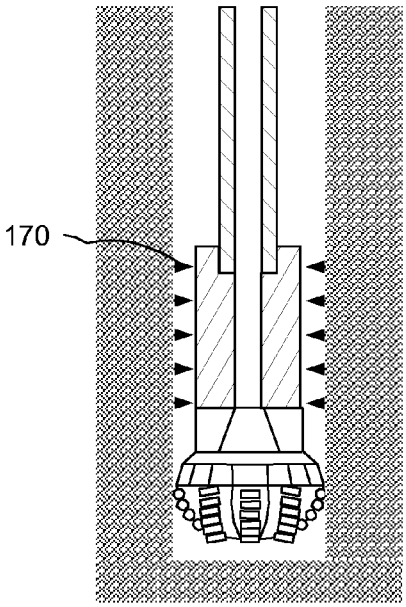
FIG. 12F illustrates a kick by the formation being drilled.
Figure 12D:
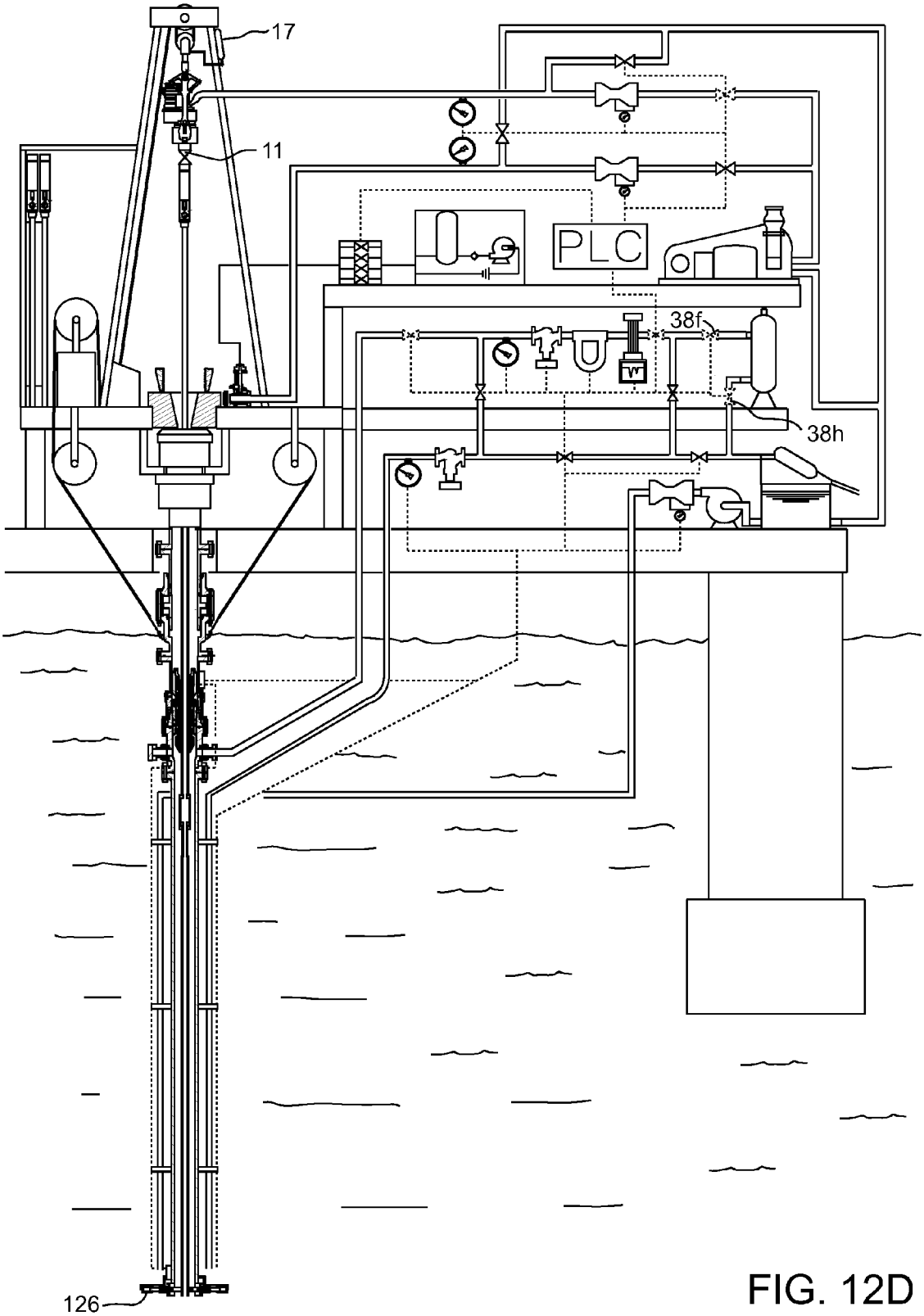

FIGS. 12D and 12E illustrate the drilling system in a degassing mode. FIG. 12F illustrates a kick by the formation being drilled. Use of the alternative heave compensation system may also be advantageous should a well control event, such as a kick 170, occur during drilling. In response to detection of the kick 170, the drilling system may be shifted to a degassing mode. To shift the drilling system to the degassing mode, drilling may be halted by stopping advancement 16*a* and rotation 16*r* of the top drive 5. The drill string may then be raised to lift the drill bit 15 off a bottom of the wellbore 55. The PLC may halt injection of the drilling fluid 60*d* by the mud pump 30*d* and the Kelly valve 11 may be closed. The drill string gripper 126 may then be engaged with the drill string, thereby anchoring the lower portion 147*b* of the drill string to the riser 148. The tensioner 151 need not be operated as the rig compensator 17 may remain engaged in the degassing and well control modes.

The PLC may then close one or more of the BOPs, such as the annular BOP 42*a* and pipe ram BOP 42*u*, against an outer surface of the drill pipe 10*p*. The PLC 75 may close the fifth 38*e* and seventh 38*g* shutoff valves and open the sixth 38*f* and eighth 38*h* shutoff valves. The PLC may then open the first booster line shutoff valve 45*a* and operate the booster pump 30*b*, thereby pumping drilling fluid 60*d* into a top of the booster line 27. The drilling fluid 60*d* may flow down the booster line 27 and into the upper flow cross 41*u* via the open shutoff valve 45*a*.

The drilling fluid 60*d* may flow through the LMRP and into a lower end of the riser 148, thereby displacing any contaminated returns 171 present therein. The drilling fluid 60*d* may flow up the riser 148 and drive the contaminated returns 171 out of the riser. The contaminated returns 171 may be driven up the riser 148 to the RCD 26. The contaminated returns 171 may be diverted by the RCD 26 into the return line 29 via the RCD outlet. The contaminated returns 171 may continue from the return line 29, through the open first shutoff valve 38*a* and first tee 39*a*, and into the first spool. The contaminated returns 171 may flow through the MP choke 36*a*, the flow meter 34*r*, the gas detector 31, and the open fourth shutoff valve 38*d* to the third tee 39*c*. The contaminated returns 171 may continue into an inlet of the MGS 32 via the open sixth shutoff valve 38*f*. The MGS 32 may degas the contaminated returns 171 and a liquid portion thereof may be discharged into the third splice. The liquid portion of the contaminated returns 171 may continue into the shale shaker 33 via the open eighth shutoff valve 38*h* and the fifth tee 39*e*. The shale shaker 33 may process the contaminated liquid portion to remove the cuttings and the processed contaminated liquid portion may be diverted into a disposal tank (not shown).

As the riser 148 is being flushed, the gas detector 31 may capture and analyze samples of the contaminated returns 171 to ensure that the riser has been completely degassed. Once the riser 148 has been degassed, the PLC may shift the drilling system into a managed pressure well control mode (not shown). If the event that triggered the shift was lost circulation, the returns may or may not have been contaminated by fluid from the lower formation 54*b*.

Alternatively, if the booster pump 30*b* had been operating in drilling mode to compensate for any size discrepancy, then the booster pump 30*b* may or may not remain operating during shifting between drilling mode and riser degassing mode.

To shift the drilling system to the managed pressure well control mode (not shown), the PLC may halt injection of the drilling fluid 60*d* by the booster pump 30*b* and close the booster line shutoff valve 45*a*. The Kelly valve 11 may be opened. The PLC may close the first shutoff valve 38*a* and open the second shutoff valve 38*b*. The PLC may then open the second choke line shutoff valve 45*e* and operate the mud pump 30*d*, thereby pumping drilling fluid 60*d* into a top of the drill string 10 via the top drive 5. The drilling fluid 60*d* may be flow down through the drill string 10 and exit the drill bit 15, thereby displacing the contaminated returns 171 present in the annulus 56. The contaminated returns 171 may be driven through the annulus 56 to the wellhead 50. The contaminated returns 171 may be diverted into the choke line 28 by the closed BOPs 41*a,u* and via the open shutoff valve 45*e*. The contaminated returns 171 may be driven up the choke line 28 to the WC choke 36*m*. The WC choke 36*m* may be fully relaxed or be bypassed.

The contaminated returns 171 may continue through the WC choke 36*m* and into the first branch via the second tee 39*b*. The contaminated returns 171 may flow into the first spool via the open second shutoff valve 38*b* and first tee 39*a*. The contaminated returns 171 may flow through the MP choke 36*a*, the flow meter 34*r*, the gas detector 31, and the open fourth shutoff valve 38*d* to the third tee 39*c*. The contaminated returns 171 may continue into the inlet of the MGS 32 via the open sixth shutoff valve 38*f*. The MGS 32 may degas the contaminated returns 61*r* and a liquid portion thereof may be discharged into the third splice. The liquid portion of the contaminated returns 171 may continue into the shale shaker 33 via the open eighth shutoff valve 38*h* and the fifth tee 39*e*. The shale shaker 33 may process the contaminated liquid portion to remove the cuttings and the processed contaminated liquid portion may be diverted into a disposal tank (not shown).

A flow rate of the mud pump 30*d* for managed pressure well control may be reduced relative to the flow rate of the mud pump during the drilling mode to account for the reduced flow area of the choke line 28 relative to the flow area of the riser annulus. If the trigger event was a kick, as the drilling fluid 60*d* is being pumped through the drill string, annulus 56, and choke line 28, the gas detector 31 may capture and analyze samples of the contaminated returns 171 and the flow meter 34*r* may be monitored so the PLC may determine a pore pressure of the lower formation 54*b*. If the trigger event was lost circulation (not shown), the PLC may determine a fracture pressure of the formation. The pore/fracture pressure may be determined in an incremental fashion, i.e. for a kick, the MP choke 36*a* may be monotonically or gradually tightened until the returns are no longer contaminated with production fluid. Once the back pressure that ended the influx of formation is known, the PLC may calculate the pore pressure to control the kick. The inverse of the incremental process may be used to determine the fracture pressure for a lost circulation scenario.

Once the PLC has determined the pore pressure, the PLC may calculate a pore pressure gradient and a density of the drilling fluid 60*d* may be increased to correspond to the determined pore pressure gradient. The increased density drilling fluid may be pumped into the drill string until the annulus 56 and choke line 28 are full of the heavier drilling fluid. The riser 148 may then be filled with the heavier drilling fluid. The PLC may then shift the drilling system back to drilling mode and drilling of the wellbore through the lower formation may continue with the heavier drilling fluid such that the returns therefrom maintain at least a balanced condition in the annulus 56.

Given that even the state of the art rig compensators 17 have, at best, only about a ninety-five percent efficiency, without use of the drill string gripper 126, the drill string would heave (albeit by a reduced amount) through the closed BOPs. This reduced heave reduces both the sealing capacity and service life of the closed BOPs. Use of the drill string gripper 126 during degassing and well control modes eliminates any heave from burdening the closed BOPs.

Additionally, the alternative heave compensation system of FIG. 10A may also be used in a similar fashion to handle a well control event.

Alternatively, any of the above heave compensation systems may be used to assemble a work string during the deployment of a casing or liner string into the subsea wellbore.

While the foregoing is directed to embodiments of the present disclosure, other and further embodiments of the disclosure may be devised without departing from the basic scope thereof, and the scope of the invention is determined by the claims that follow.

The invention claimed is:

1. A method of deploying a jointed tubular string into a subsea wellbore, comprising:

lowering the tubular string into the subsea wellbore from an offshore drilling unit, wherein the tubular string has a slip joint;

sending a wireless command signal from the offshore drilling unit down the tubular string to a setting tool to set an anchor, wherein the sending the wireless command signal comprises at least one of:

pumping a wireless identification tag through the tubular string; and modulating rotation of the tubular string;

after lowering, anchoring a lower portion of the tubular string below the slip joint to a non-heaving structure;

while the lower portion is anchored:

supporting an upper portion of the tubular string above the slip joint from a rig floor of the offshore drilling unit;

after supporting, adding one or more joints to the tubular string, thereby extending the tubular string; and releasing the upper portion of the extended tubular string from the rig floor;

releasing the lower portion of the extended tubular string from the non-heaving structure; and lowering the extended tubular string into the subsea wellbore.

2. The method of claim 1, wherein the non-heaving structure is a casing string cemented in the subsea wellbore.

3. The method of claim 2, wherein:

the anchor is disposed below the slip joint, and the lower portion is anchored by setting the anchor against the casing string.

4. The method of claim 3, wherein the setting tool is disposed between the slip joint and the anchor.

5. The method of claim 4, wherein the anchor is set by the sending the wireless command signal to the setting tool and circulating fluid through the tubular string.

6. The method of claim 4, wherein:

the tubular string is rotated during lowering, rotation is ceased before anchoring, the setting tool has a controller and a tachometer, and the controller sets the anchor in response to detection of cessation of rotation using the tachometer.

7. The method of claim 1, wherein the non-heaving structure is one of: a marine riser, a lower marine riser package, and a blowout preventer (BOP) stack.

8. The method of claim 7, wherein:

the slip joint is a tensioner, the non-heaving structure has a drill string gripper, and the portion is anchored by engaging the gripper with the drill string.

9. The method of claim 8, wherein:

the tubular string is lowered through the marine riser and an upper marine riser package having a rotating control device (RCD), the method further comprises closing a BOP against the drill string, and the tensioner is operated by pressurizing the riser between the RCD and the closed BOP.

10. The method of claim 8, wherein:

fluid is circulated through the tubular string during lowering, the drill string further has a flow sub, and the tensioner is operated by engaging a clamp with the flow sub to maintain circulation during anchoring.

11. The method of claim 8, further comprising engaging the gripper with the drill string in response to detection of a well control event.

12. The method of claim 8, wherein:

the tubular string is a drill string having a drill bit at a bottom thereof, and fluid is circulated through the drill string and the drill bit is rotated during lowering, thereby drilling the wellbore.

13. The method of claim 1, wherein the setting tool comprises an antenna.

14. A heave compensation system for assembling a jointed tubular string, comprising:

a jointed tubular string comprising:

a slip joint;

an anchor comprising slips movable between an extended position and a retracted position; and a setting tool connecting the slip joint to the anchor, comprising:

an actuation piston operable to move the slips between the positions;

a plurality of toggle valves, each valve in fluid communication with a respective face of the setting actuation piston and operable to alternately provide fluid communication between the respective piston face and either a bore of the setting tool or an exterior of the setting tool;

an electronics package operable to alternate the toggle valves; and an antenna; and a wireless identification tag, pumpable through the tubular string, and operable to transmit a command signal to the antenna.

15. A method of deploying a jointed tubular string into a subsea wellbore, comprising:

lowering the tubular string into the subsea wellbore from an offshore drilling unit, wherein the tubular string has a slip joint;

after lowering, anchoring a lower portion of the tubular string below the slip joint to a non-heaving structure, wherein the non-heaving structure is one of: a marine riser, a lower marine riser package, and a blowout preventer (BOP) stack;

while the lower portion is anchored:

supporting an upper portion of the tubular string above the slip joint from a rig floor of the offshore drilling unit;

after supporting, adding one or more joints to the tubular string, thereby extending the tubular string; and releasing the upper portion of the extended tubular string from the rig floor;

releasing the lower portion of the extended tubular string from the non-heaving structure; and lowering the extended tubular string into the subsea wellbore, wherein:

the slip joint is a tensioner, the non-heaving structure has a drill string gripper, and the portion is anchored by engaging the gripper with the drill string.

16. The method of claim 15, wherein:

the tubular string is lowered through the marine riser and an upper marine riser package having a rotating control device (RCD), the method further comprises closing a BOP against the drill string, and the tensioner is operated by pressurizing the riser between the RCD and the closed BOP.

17. The method of claim 15, wherein:

fluid is circulated through the tubular string during lowering, the drill string further has a flow sub, and the tensioner is operated by engaging a clamp with the flow sub to maintain circulation during anchoring.

18. The method of claim 15, further comprising engaging the gripper with the drill string in response to detection of a well control event.

19. The method of claim 15, wherein:

the tubular string is a drill string having a drill bit at a bottom thereof, and fluid is circulated through the drill string and the drill bit is rotated during lowering, thereby drilling the wellbore.

* * * * *